US005463287A

United States Patent [19]

Kurihara et al.

[11] Patent Number: 5,463,287

[45] Date of Patent: Oct. 31, 1995

[54] DISCHARGE LAMP LIGHTING APPARATUS WHICH CAN CONTROL A LIGHTING PROCESS

[75] Inventors: Makoto Kurihara, Tokyo; Masaru Wasaki, Chiba, both of Japan

[73] Assignee: TDK Corporation, Tokyo, Japan

[21] Appl. No.: 318,361

[22] Filed: Oct. 5, 1994

[30] Foreign Application Priority Data

| | | | |
|---|---|---|---|
| Oct. 6, 1993 | [JP] | Japan | 5-272982 |
| Oct. 27, 1993 | [JP] | Japan | 5-289839 |
| Oct. 27, 1993 | [JP] | Japan | 5-289840 |
| Oct. 27, 1993 | [JP] | Japan | 5-289841 |
| Oct. 28, 1993 | [JP] | Japan | 5-291505 |

[51] Int. Cl.[6] ..... G05F 1/00

[52] U.S. Cl. ..... 315/308; 315/291; 315/209 T; 315/209 CD

[58] Field of Search ..... 315/289, 307, 315/308, 219, 209 T, 209 CD, 291

[56] References Cited

U.S. PATENT DOCUMENTS

| | | | |
|---|---|---|---|
| 5,140,229 | 8/1992 | Yagi et al. | 315/307 |
| 5,204,587 | 4/1993 | Mortimer et al. | 315/308 |
| 5,381,074 | 1/1995 | Rudzewicz et al. | 315/308 |

FOREIGN PATENT DOCUMENTS

| | | |
|---|---|---|
| 0536535A1 | 4/1993 | European Pat. Off. . |
| 2-136343 | 5/1990 | Japan . |
| 4-272696 | 9/1992 | Japan . |
| 4-342993 | 11/1992 | Japan . |

*Primary Examiner*—Robert J. Pascal
*Assistant Examiner*—Reginald A. Ratliff
*Attorney, Agent, or Firm*—Nikaido, Marmelstein, Murray & Oram

[57] ABSTRACT

A lighting apparatus for a discharge lamp (15) has a power adjustment unit (11,13) for adjusting electrical power to be supplied to the discharge lamp, an ignition pulse circuit (17) for producing at least one ignition pulse to be applied to the discharge lamp, and a computer control circuit (19) electrically connected with the power adjustment unit and the ignition pulse circuit. The computer control circuit (19) controls the power adjustment unit and the ignition pulse circuit so that at first the power adjustment unit (11,13) supplies an idling voltage to the discharge lamp, then the ignition pulse circuit (17) lights up the discharge lamp by applying at least one ignition pulse to the discharge lamp, and thereafter the power adjustment unit (11,13) controls lamp power of the discharge lamp to a target lamp power.

15 Claims, 28 Drawing Sheets

| X | Y | Z |
|---|---|---|
| L | L | 0 |
| H | L | 1 |
| L | H | 2 |
| H | H | 3 |

| A | B | C |
|---|---|---|
| L | L | 0 |
| H | L | 1 |
| L | H | 2 |
| H | H | 3 |

DISCHARGE LAMP LIGHTING APPARATUS WHICH CAN CONTROL A LIGHTING PROCESS

BACKGROUND OF THE INVENTION

1. Field of the Invention

The present invention relates to an apparatus for lighting a High-Intensity Discharge (HID) lamp, such as a high pressure mercury lamp or a metal halide lamp. Particularly, the present invention relates to a discharge lamp lighting apparatus which can control in detail lighting processes of a high pressure discharge lamp depending upon its individual characteristics and also upon its operating state.

2. Description of the Related Art

Since the HID lamp is in general lighted through various phases of (1) occurrence of Townsent current, (2) occurrence of glow discharge, (3) growth of arc discharge, and (4) stable arc discharge, very complicated lighting process controls are necessary for ensuring stable lighting. In a conventional discharge lamp lighting apparatus, most of such the complicated process controls are executed by using various timers and analog circuits (described in, for example, EP-A1-0 536 535). Thus, the conventional apparatus has to be constituted by a large number of analog components and therefore has complicated structure and large size, resulting its manufacturing cost to extremely increase.

Furthermore, according to such the analog type lighting control apparatus, detail and adaptive lighting control of the lamp depending upon its individual characteristics and also upon its operating state cannot be expected.

For the lighting apparatus, since there are many kinds of discharge lamps having different lamp characteristics, a general purpose lighting apparatus, not specially designed lighting apparatus is desired.

For a discharge lamp lighting apparatus, furthermore, detail control to secure safety operation of the discharge lamp and protection of the discharge lamp are required. For example, safety control for preventing excess ignition pulses against the lamp at starting from occurring will be necessary, and also protection of the discharge lamp by stopping the operation of the lighting control apparatus when its internal circuit such as an inverter circuit malfunctions will be necessary.

SUMMARY OF THE INVENTION

It is therefore an object of the present invention to provide a discharge lamp lighting apparatus with a simple constitution, which can execute a detail lighting process control of a discharge lamp.

Another object of the present invention is to provide a discharge lamp lighting apparatus which can be easily adapted to various kinds of discharge lamps.

Further object of the present invention is to provide a discharge lamp lighting apparatus with a simple constitution, which can ensure safe lighting process control of a discharge lamp.

According to the present invention, a lighting apparatus for a discharge lamp has a power adjustment unit for adjusting electrical power to be supplied to the discharge lamp, an ignition pulse circuit for producing at least one ignition pulse to be applied to the discharge lamp, and a computer control circuit electrically connected with the power adjustment unit and the ignition pulse circuit. The computer control circuit controls the power adjustment unit and the ignition pulse circuit so that at first the power adjustment unit supplies an idling voltage to the discharge lamp, then the ignition pulse circuit lights up the discharge lamp by applying at least one ignition pulse to the discharge lamp, and thereafter the power adjustment unit controls lamp power of the discharge lamp to a target lamp power.

It should be noted that the above-mentioned lighting process control of the discharge lamp can be realized only by using a programed computer. Namely, the lighting process control using a computer permits detail process control of the discharge lamp even if the lighting control apparatus itself has very simple constitution. This causes the lighting apparatus to downsize and to manufacture with a lower cost.

Furthermore, according to the present invention, since the lighting of the each lamp is controlled by adjusting its lamp power, a constant power can be always supplied to the each lamp even if the lamp voltage differs from each other due to scattered characteristics of the individual lamp. As a result, difference of rise time of the lamp flux can be compensated and also shortening of the life of the lamp due to excess power supply can be prevented.

It is preferred that the apparatus further includes a detection circuit for detecting a lighting condition of the discharge lamp, and that the computer control circuit stops power supply to the discharge lamp from the power adjustment unit if it is judged, depending upon a detected result of the detection circuit, that the lighting condition of the discharge lamp is abnormal.

The detection circuit may be a current detection circuit for detecting a current corresponding to a lamp current of the discharge lamp to output a signal which represents the detected current. In this case, the computer control circuit stops power supply to the discharge lamp from the power adjustment unit if it is judged that the signal exceeds a predetermined value.

The detection circuit may be a voltage detection circuit for detecting a voltage corresponding to a lamp voltage of the discharge lamp to output a signal which represents the detected voltage. In this case, the computer control circuit stops power supply to the discharge lamp from the power adjustment unit if it is judged that signal exceeds a predetermined value.

The detection circuit may be a current detection circuit for detecting a current corresponding to a lamp current of the discharge lamp to output a first signal which represents the detected current and a voltage detection circuit for detecting a voltage corresponding to a lamp voltage of the discharge lamp to output a second signal which represents the detected voltage. In this last case, the computer control circuit calculates a lamp power of the discharge lamp from the first and second signals to produce a control signal for controlling the power adjustment unit in accordance with the calculated lamp power, and stops power supply to the discharge lamp from the power adjustment unit if it is judged that the calculated lamp power exceeds a predetermined allowable power.

In the last case, the power adjustment unit may have a DC/DC converter circuit for converting a source voltage into a DC voltage so as to adjust electrical power to be supplied to the discharge lamp, and an inverter circuit for inverting the DC voltage from the DC/DC converter circuit into an AC voltage. In this case, the computer control circuit will calculate a lamp power of the discharge lamp from the first and second signals to produce a control signal for controlling the DC/DC converter circuit in accordance with the calculated lamp power, and stop power supply to the discharge lamp from the DC/DC converter circuit if it is judged that a first or second signal which is sampled in synchronous with the alternating operation of the inverter circuit exceeds a predetermined value.

According to this case, since the wave forms of the first or second signal can be checked, detail diagnosis of the lamp state and the lighting apparatus such as troubles of inverter circuit elements which could not be checked according to the conventional system can be easily carried out. As a result, reliability of trouble-diagnosis function will be extremely improved. It should be noted that these detail judgment of the wave forms can be realized only by using a computer. Namely, the lighting process control using a computer permits detail process control of the discharge lamp even if the lighting control apparatus has very simple constitution.

It is preferred that the computer control circuit checks a lamp current signal from the current detection circuit to judge whether the discharge lamp is lighted or not, at each time when one ignition pulse is applied to the discharge lamp, and stops production of the ignition pulse from the ignition pulse circuit if the lamp is lighted.

Since the computer control circuit checks in real time whether the lamp is lighted up or not at each time one ignition pulse with high voltage being applied, and then if it is lighted, the lamp power control at starting is immediately executed without producing next ignition pulse. Thus, only the minimum necessary number of high voltage ignition pulses will be supplied to the lamp causing safety operation of the lighting apparatus and the lamp to extremely improve.

Furthermore, since a next ignition pulse is immediately applied to the lamp when going out of the lamp is detected, a certain discharge lamp such as a metal halide lamp, which is relatively difficult to start can be certainly lighted.

Preferably, the computer control circuit stops production of the ignition pulse from the ignition pulse circuit when the discharge lamp is not lighted although a predetermined time period is elapsed after the first ignition pulse was applied to the lamp, or when the discharge lamp is not lighted although a predetermined number of the ignition pulses are sequentially applied to the lamp.

It is preferred that the computer control circuit determines a limiting value of a lamp current of the discharge lamp depending upon a value of the detected lamp voltage just after the lamp is lighted, and controls the power adjustment unit so that the lamp current supplied to the lamp from the power adjustment unit is equal to or less than the above-mentioned determined limiting value.

Thus, the upper limit of the lamp current can be set to a proper value at hot-start condition and to an another proper value at cold-start condition. Namely, lighting control at starting can be conducted by an adaptive lamp current depending upon actual temperature of the discharge lamp. In other words, damages on the discharge lamp such as melting of lamp electrodes caused by excess power input at the hot-start condition can be prevented from occurring without protracting starting time period of the lamp at the cold-start condition or without going out the lamp at the cold-start condition. Since excess power will not applied to the lighting control apparatus itself at the hot-start condition, its internal circuits will not be damaged and also breakers or fuses provided in or out of the lighting control apparatus will not operate in error. Furthermore, since the lamp voltage just after lighting is detected and then the detected lamp voltage is used for controlling the lamp power, excess power will not be applied to the lamp even if individual lamp voltages of the respective discharge lamps are scattered.

Preferably, the apparatus has a memory for storing a last lamp power just before the discharge lamp was lighted out at last time, and a time detection circuit for detecting a time period of the last lights-out of the discharge lamp, and the computer control circuit calculates a lamp power of the discharge lamp from the detected lamp current and voltage to produce a control signal for controlling the power adjustment unit and also calculates an initial lamp power at starting by using an approximate equation with respect to variables of the last lamp power and the time period of lights-out. The power adjustment unit will control the lamp power to be supplied to the discharge lamp at starting to approach this calculated initial lamp power.

Since starting lamp power is controlled by seizing the actual condition of the lamp depending upon both the last lamp power just before lighting out and the light-off period, the lamp can be started with enough lamp power in every lamp condition even in a case the light-on period is short and the following light-off period is also short. Thus, the lamp can be certainly lighted and rapid rise of the lamp flux can be expected.

The computer control circuit may calculate the initial lamp power at starting $P_{on}$ by using the approximate equation of, $$P_{on}=(P_m-P_{off})\times(1-e^{-T_{off}/\beta})+P_{off}$$

where $P_m$ is the maximum lamp power at starting, $P_{off}$ is the last lamp power, $T_{off}$ is the time period of lights-out, and $\beta$ is a constant.

Then, the computer control circuit may calculate a lamp power after starting $P_{exp}$ by using the approximate equation of, $$P_{exp}=(P_{on}-P_{set})\times e^{-T_{on}/\alpha}+P_{set}$$

where $P_{set}$ is a nominal lamp power, $T_{on}$ is a time period of lighting, and $\alpha$ is a constant. Thus, the power adjustment unit will control the lamp power supplied to the discharge lamp after starting to the calculated lamp power $P_{exp}$.

It is preferred that the computer control circuit regulates the calculated initial lamp power to a value equal to or less than the maximum allowable lamp power $P_{limt}$ of the discharge lamp.

It is preferred that apparatus has an amplifier circuit for amplifying the detected current signal with a plurality of amplification factors which are different from each other. The computer control circuit controls the lamp power to be supplied to the discharge lamp by using a signal amplified with a lower amplification factor during starting condition, and by using a signal amplified with a higher amplification factor during stable condition.

Namely, at starting condition wherein the actual lamp current will be large, the lamp current signal amplified by the amplifier having the lower amplification factor is used for controlling the lamp power. Thus, at cold-start condition, a detection range of the lamp current will become very wide, in other words, a very large lamp current at cold-start condition can be detected. However, this will result poor resolution. At stable condition wherein the actual lamp current is relatively small, the other lamp current signal amplified by the amplifier having the higher amplification factor is used. Thus, high resolution can be expected although the detection range of the lamp current will be narrow. As a result, high accurate control of the lamp power at its stable condition can be executed, and also quick response against changes in the power supply voltage, in the lamp condition and in the lamp temperature can be expected causing flicker of the lamp to prevent from occurring.

Preferably, the computer control circuit stops production of the ignition pulse from the ignition pulse circuit if the lamp current, after the idling voltage is applied to the discharge lamp but before any ignition pulse is applied to the lamp, exceeds a predetermined value.

Thus, if a dummy resistor is connected to the output of the lighting apparatus instead of a discharge lamp to measure the output power of the lighting apparatus, the computer control circuit automatically detects it and executes the stable power control process without applying any ignition pulse to the dummy resistor and also without executing the starting power control process. As a result, the lighting apparatus is extremely safety and a power measuring device can be protected from possible troubles due to the appearance of the high voltage ignition pulses and the great power which will be several times of the nominal power. Also, since the lighting apparatus automatically detects that the resistor load is connected instead of the discharge lamp, no manual switch for stopping the application of ignition pulses will be necessary.

It is preferred that the computer control circuit stops power supply to the discharge lamp from the power adjustment unit if the detected lamp voltage signal just after the idling voltage is applied to the discharge lamp indicates an abnormal lamp voltage.

The apparatus may further have a set switch capable of supplying a variable digital signal to the computer control circuit. The computer control circuit may preliminarily store a plurality of different target lamp powers, and select one of the stored target lamp powers depending upon the variable signal from the set switch.

Thus, the same lighting apparatus can be adapted to various discharge lamps having different nominal powers only by switching the set switch without adjusting a power control volume or without rewriting the control program.

The power adjustment unit may selectively supply DC power or AC power to the discharge lamp, and the computer control circuit may preliminarily store a plurality of different periods of the DC power supply, and select one of the stored periods depending upon the variable digital signal from the set switch.

Further objects and advantages of the present invention will be apparent from the following description of the preferred embodiments of the invention as illustrated in the accompanying drawings.

DESCRIPTION OF THE PREFERRED EMBODIMENTS

First Embodiment

Figure 1:
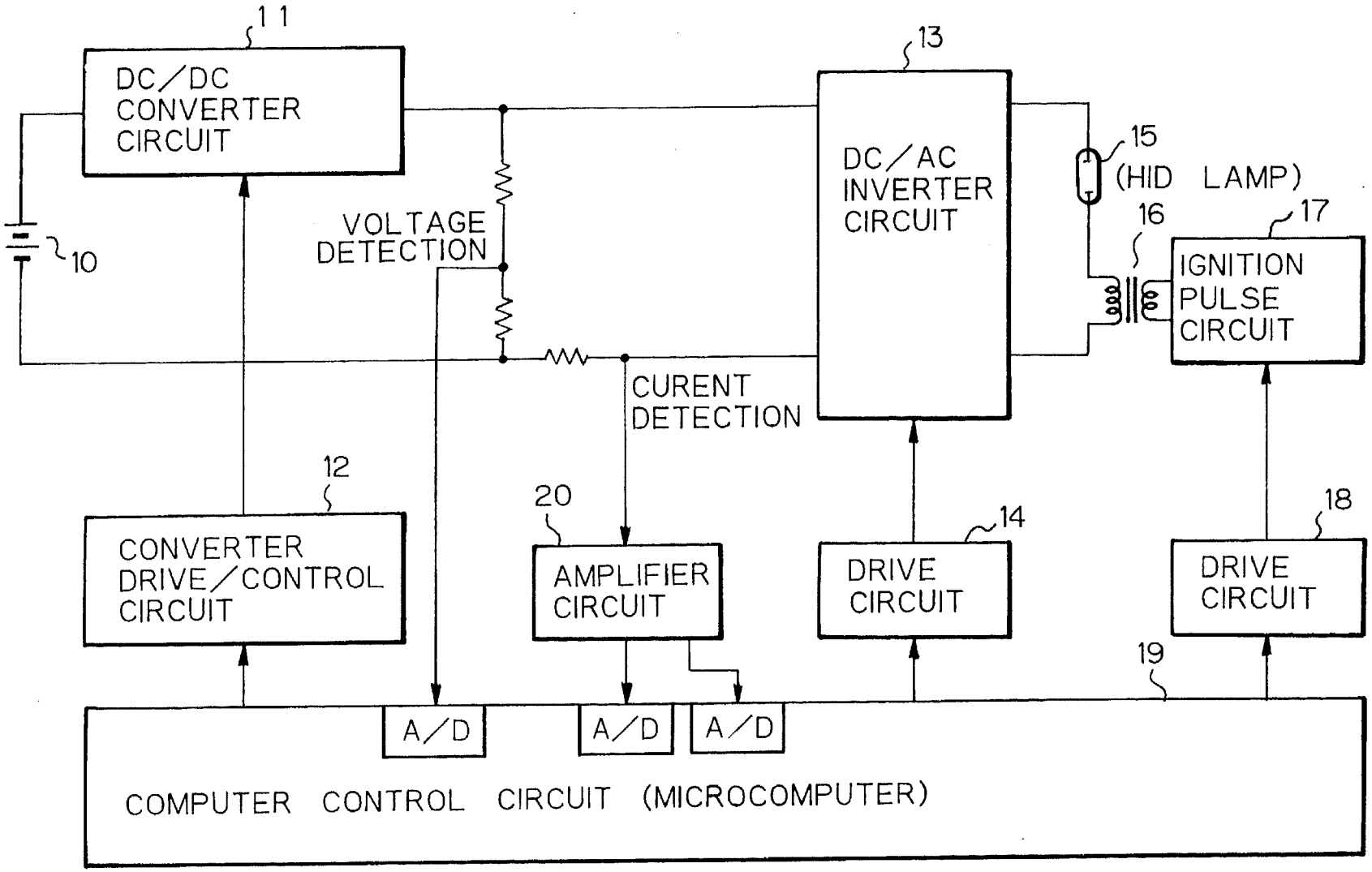
FIG. 1 shows a schematic block diagram of a preferred first embodiment of a discharge lamp lighting apparatus according to the present invention.

FIG. 1 shows a schematic block diagram of a preferred first embodiment of a discharge lamp lighting apparatus according to the present invention.

In the figure, reference numerals 10 denotes a DC power source such as a battery or an AC/DC rectifying device, and 11 denotes a DC/DC converter circuit or a chopper circuit of boosting or dropping type, connected to the DC source 10. The DC/DC converter circuit 11 variably controls its output current or output power in accordance with a signal from a converter drive/control circuit 12. A DC/AC inverter circuit 13 is connected to the output side of the DC/DC converter circuit 11. This inverter circuit 13 can selectively produce DC output or AC output in accordance with a signal from a drive circuit 14. An HID (High-Intensity Discharge) lamp 15 such as a high pressure mercury lamp or a metal halide lamp and a secondary winding of a transformer 16 for producing high-voltage ignition pulses are connected in series to an output of the inverter circuit 13. A primary winding of the transformer 16 is connected to an output of an ignition pulse circuit 17 which is driven by a signal from a drive circuit 18. It should be noted that if the HID lamp 15 is a DC lighted type, the inverter circuit 13 and therefore its drive circuit 14 can be omitted.

The drive/control circuit 12 and the drive circuits 14 and 18 are connected to a computer control circuit 19 substantially constituted by a microcomputer so as to operate depending upon controls signals from this computer control circuit 19. An amplifier circuit 20 which amplifies a current signal corresponding to a lamp current is also connected to the computer control circuit 19. To this control circuit 19, a voltage signal which corresponds to a lamp voltage is inputted.

Figure 2:
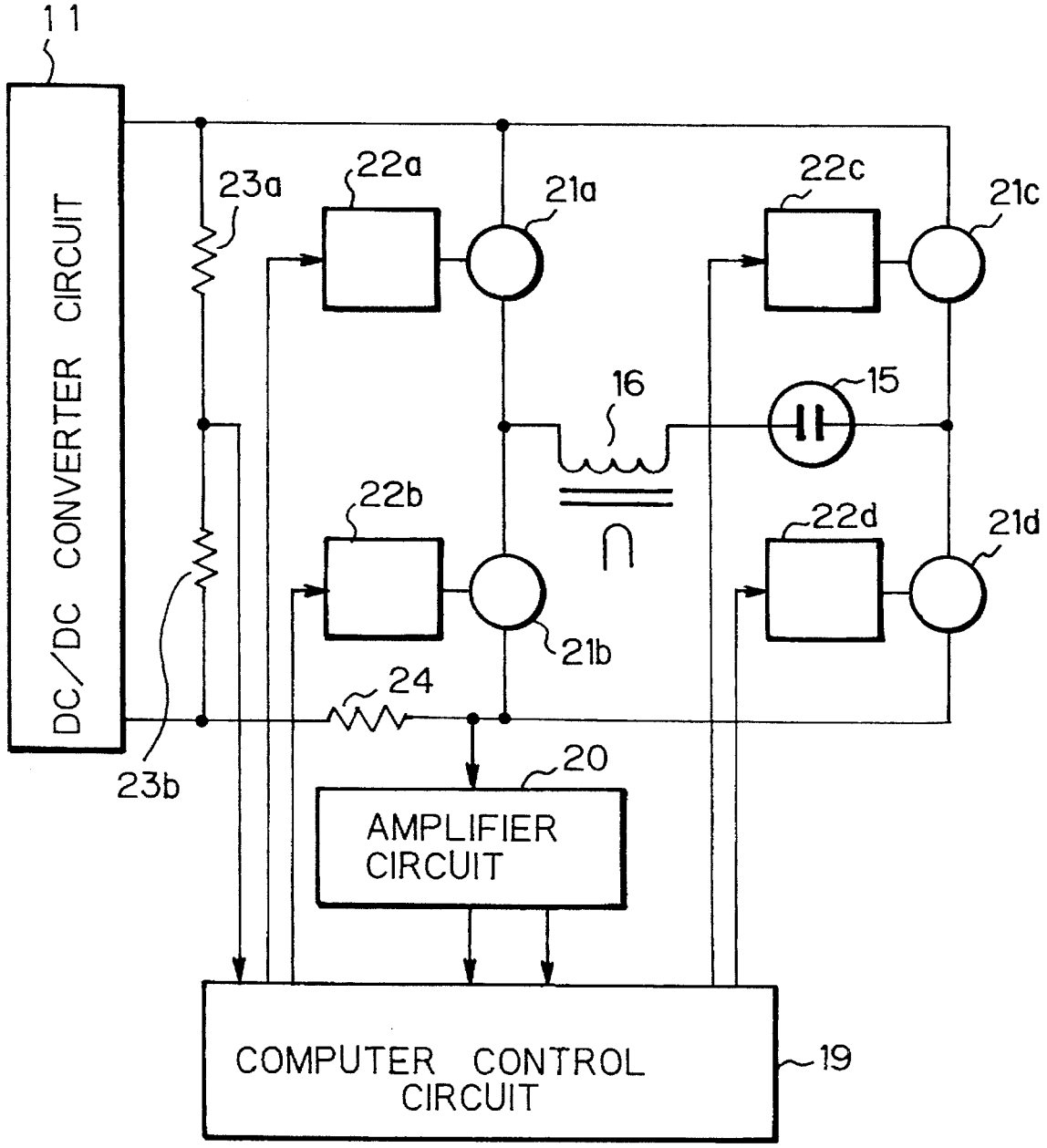
FIG. 2 shows a detail block diagram of a DC/AC inverter circuit according to the first embodiment.

FIG. 2 shows a concrete example the inverter circuit 13 in the first embodiment.

In the figure, reference numerals 21*a*, 21*b*, 21*c* and 21*d* denote switching elements of the inverter circuit 13, connected in a full bridge configuration. Each of these switching elements 21*a*, 21*b*, 21*c* and 21*d* is made by for example an FET element. Drivers 22*a*, 22*b*, 22*c* and 22*d* constituting the driver circuit 14 are connected to control terminals (gates) of the FET elements 21*a*, 21*b*, 21*c* and 21*d*, respectively. During DC to AC inversion operation, the switching elements are driven by the drivers so that the switching elements 21*a* and 21*d* (A channel) and the switching elements 21*b* and 21*c* (B channel) alternately turn on and off.

Dividing resistors 23*a* and 23*b* for detecting the voltage signal which represents a lamp voltage are connected across the output of the DC/DC converter circuit 11. A resistor 24 for detecting the current signal which represents a lamp current is connected between the converter circuit 11 and the switching elements 21*b* and 21*d* of the inverter circuit 13. One end of the resistor 24 is connected to the aforementioned amplifier circuit 20.

Before describing operations of the discharge lamp lighting apparatus of this embodiment in detail, a fundamental lighting process of the HID lamp will be shortly explained.

Figures 3A, 3B, 3C, 3D:
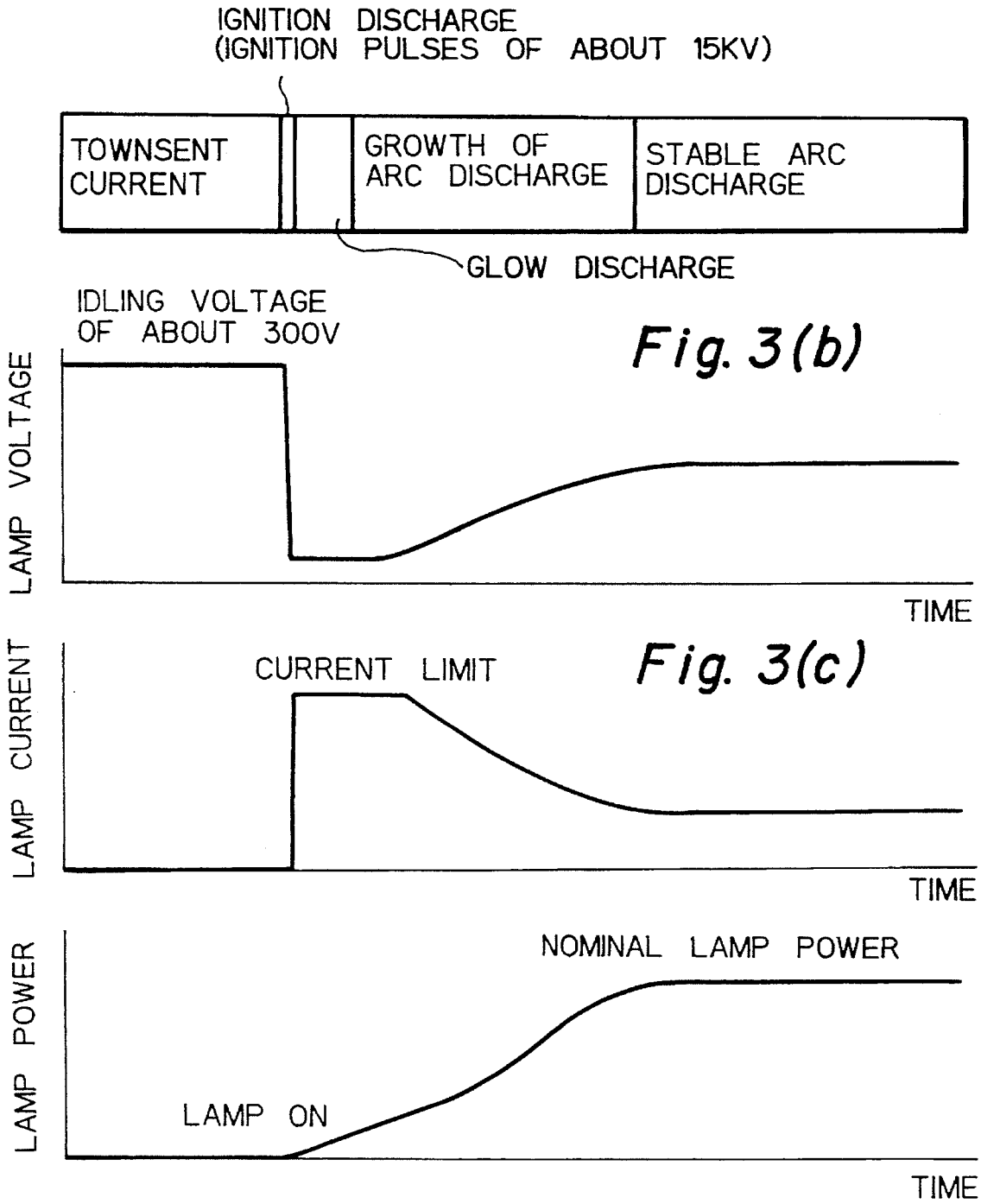
FIG. 3 shows various phases in the lighting process of an HID lamp and transitions of its lamp voltage, lamp current and lamp power.

FIG. 3 shows various phases in the lighting process of an HID lamp, and variations of its lamp voltage, lamp current and lamp power. As will be apparent from this figure, the HID lamp is lighted through phases of (1) Townsent current (idling voltage of about 300 V will be applied to the lamp), (2) ignition discharge (ignition pulses of about 15 kV will be applied to the lamp), (3) glow discharge (large lamp current will flow), (4) growth of arc discharge (lamp current will gradually decrease but lamp voltage will gradually increase), and (5) stable arc discharge (the lamp power will be saturated to its nominal lamp power).

Figure 4:
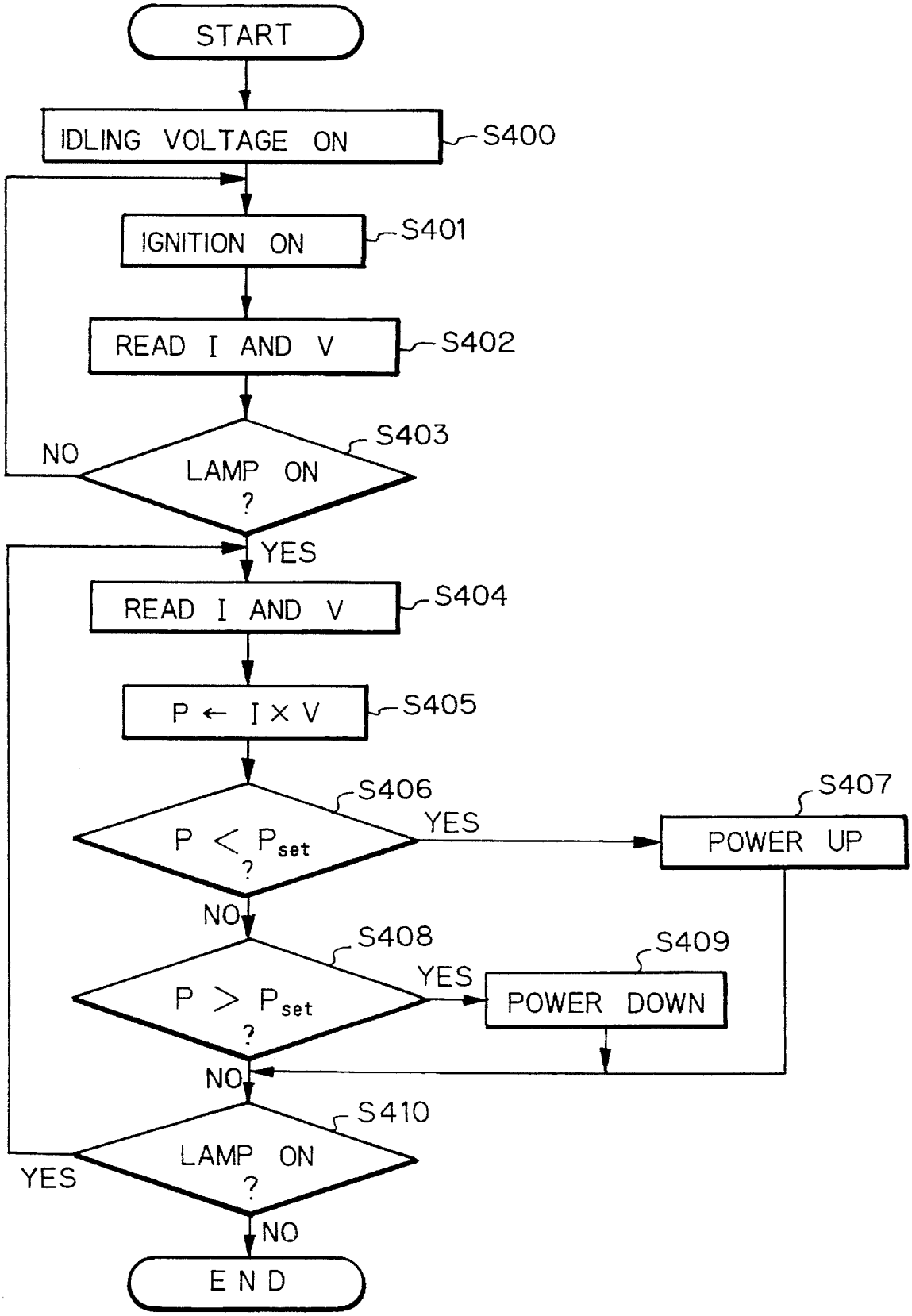
FIG. 4 shows a flow chart schematically representing a part of a control program of a microcomputer in a control circuit of a first embodiment.

FIG. 4 shows a flow chart schematically representing a part of a control program of the microcomputer in the computer control circuit 19 of the first embodiment.

When an input switch of the lighting apparatus (not shown) is turned on, DC power from the source 10 is supplied to each of the circuits and then the microcomputer in the control circuit 19 starts the following operations based upon the flow chart of FIG. 4.

First, at step S400, the computer control circuit 19 outputs respective control signals to the drive/control circuit 12 and to the drive circuit 14 so that the DC/DC converter circuit 11 outputs an idling voltage of for example about DC 300 V. The idling voltage is then applied to the HID lamp 15 through the inverter circuit 13. At this stage, Townsent current may flow in the lamp 15.

Then, at next step S401, the control circuit 19 outputs a control signal to the drive circuit 18 so that the ignition pulse circuit 17 outputs at least one trigger pulse and that at least one ignition pulse with high voltage of for example 15 kV peak voltage is produced across the secondary winding of the transformer 16. Thus, in the HID lamp 15, break down will occur to produce the glow discharge. Then, this glow discharge will glow up to arc discharge resulting lighting-up of the lamp.

The control circuit 19 then takes in a current signal which represents the lamp current via the amplifier 20 and a voltage signal which represents the lamp voltage at step S402. These current signal and voltage signal are converted into a digital current signal I and a digital voltage signal V, respectively, by A/D converters in the control circuit 19.

At next step S403, the microcomputer 19 judges whether the lamp 15 is lighted or not by comparing the lamp current I with a predetermined threshold value Ion or by comparing the lamp voltage V with a predetermined threshold value $V_{off}$. If $I>I_{on}$ or $V<V_{off}$, it is judged that the lamp is lighted up and the program proceeds to a next step S404. If it is judged that the lamp is not lighted, the program returns to the step S401 and ignition pulses will be applied to the lamp 15 again.

Steps S404 to S409 are processes of controlling lamp power to a target lamp power (generally corresponding to a nominal lamp power). At the step S404, a digital signal indicating a lamp current I and a digital signal indicating a lamp voltage V are introduced again. Then, at the next step S405, an actual lamp power P is calculated by $P=I\times V$. Thereafter, at the step S406, the calculated lamp power P is compared with a predetermined target value of the lamp power $P_{set}$ to judge whether $P<P_{set}$. If $P<P_{set}$, the program proceeds to the step S407 where a power control signal is outputted to the drive/control circuit 12 so as to increase the output power or output current from the DC/DC converter circuit 11 (power up). As a result, the actual lamp power P will approach to the target value $P_{set}$. If it is not $P<P_{set}$, a judgment whether $P>P_{set}$ is executed at the step S408. If $P>P_{set}$, the program proceeds to the step S409 where a power control signal is outputted to the drive/control circuit 12 so as to decrease the output power or output current from the DC/DC converter circuit 11 (power down). As a result, the actual lamp power P will approach to the target value $P_{set}$. Then, the program proceeds to step S410 where it is judged whether the lamp 15 is lighted or not by the same manner as that at the step S403. If it is judged that the lamp is lighted up, the program returns to the step S404 and the similar lamp power control will be repeated. If it is judged that the lamp is lighted out, the control circuit 19 stops its lighting control operation.

It should be noted that the above-mentioned lighting process control of the HID lamp can be realized only by using a programed microcomputer. Namely, the lighting process control using a microcomputer permits detail process control of the HID lamp even if the lighting control apparatus has very simple constitution. This causes the HID lamp lighting apparatus to downsize and to manufacture with a lower cost.

Furthermore, according to this embodiment, since the lighting of the each lamp is controlled by adjusting its lamp power, a constant power can be always supplied to the each lamp even if the lamp voltage differs from each other due to scattered characteristics of the individual lamp. As a result, difference of rise time of the lamp flux can be compensated and also shortening of the life of tile lamp due to excess power supply can be prevented.

Second Embodiment

Figure 5:
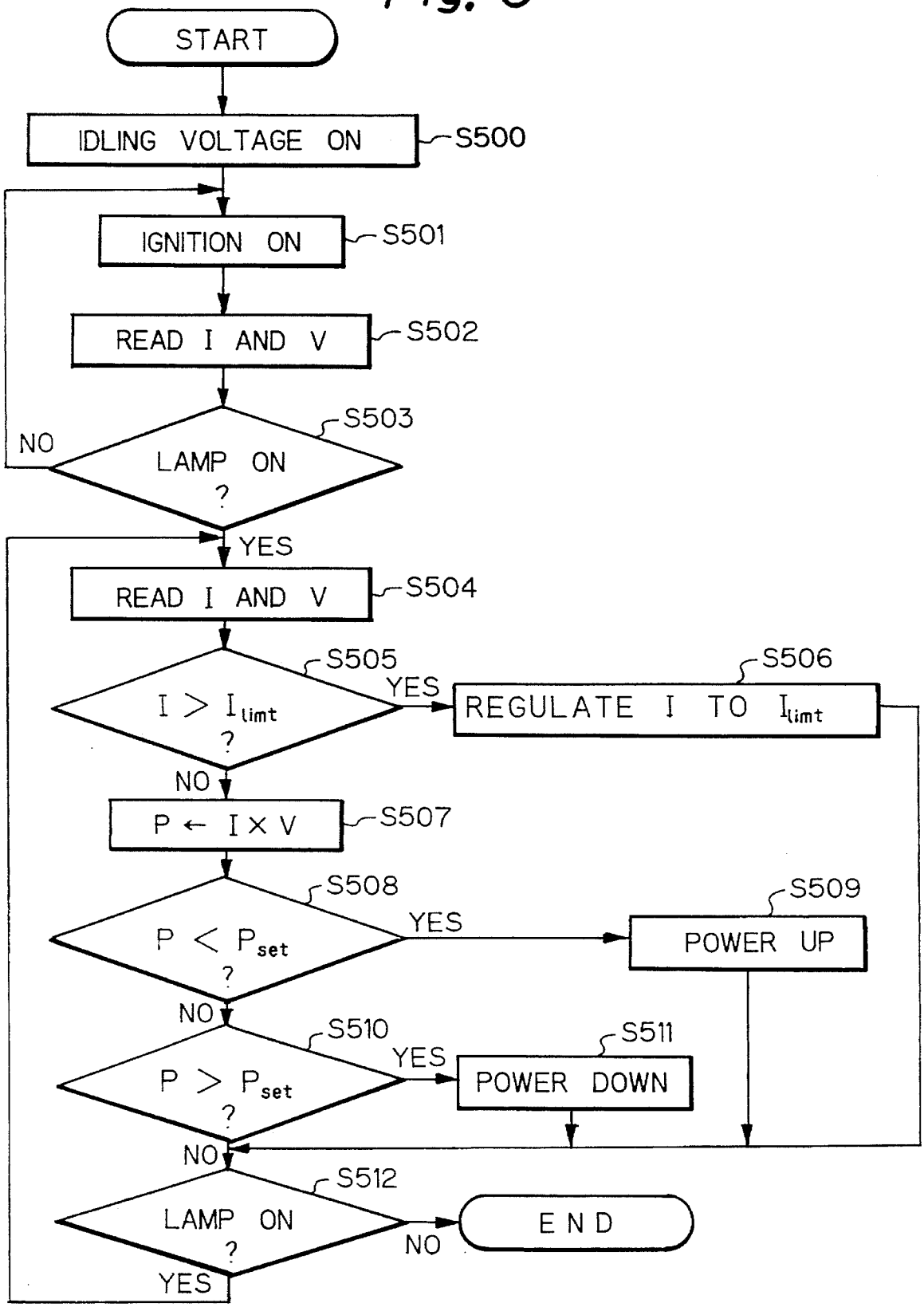
FIG. 5 shows a flow chart schematically representing a part of a control program of a microcomputer in a computer control circuit according to a second embodiment.

FIG. 5 shows a flow chart schematically representing a part of a control program of the microcomputer in a computer control circuit according to a second embodiment.

In this second embodiment, the circuit constitution of the discharge lamp lighting apparatus is the same as that of the first embodiment. Also, the operations at steps S500 to S504 and at steps S507 to S512 are substantially the same as that at the steps S400 to S404 and at the steps S405 to S410 in the first embodiment, respectively. Namely, in this embodiment, process at steps S505 and S506 are newly added to the process in the first embodiment. Therefore, operations only at these additional steps will be described hereinafter.

At the step S505 which is next to the step S504 wherein an actual lamp current I and an actual lamp voltage V are inputted, this inputted lamp current I is compared with a predetermined limiting value of the lamp current at starting $I_{limt}$. If $I>I_{limt}$, the actual lamp current I is regulated to $I_{limt}$ at the step S506. In practice, at this step S506, the computer control circuit 19 outputs a control signal against the drive/control circuit 12 so as to regulate the output current from the DC/DC converter circuit 11 to the limiting value $I_{limt}$. Thus, according to this second embodiment, the actual lamp current I, particularly the lamp current at starting, is controlled equal to or less than the constant limiting current $I_{limt}$. As a result, excess power input at starting condition, particularly at cold-start condition, can be prevented from occurring. Another advantages of this embodiment are the same as these of the first embodiment.

In some lighting control apparatuses for the HID lamp which will be used as a light source of optical projection device such as an overhead projector or liquid crystal projector, a special lighting control method called as a rectangular-wave lighting method may be used. In this method, ignition pulses are first applied to the lamp causing it to breakdown, and then DC current is supplied for a predetermined period to warm up the lamp. Then, AC current is supplied and thereafter constant power control of the lamp will be executed.

Figure 6:
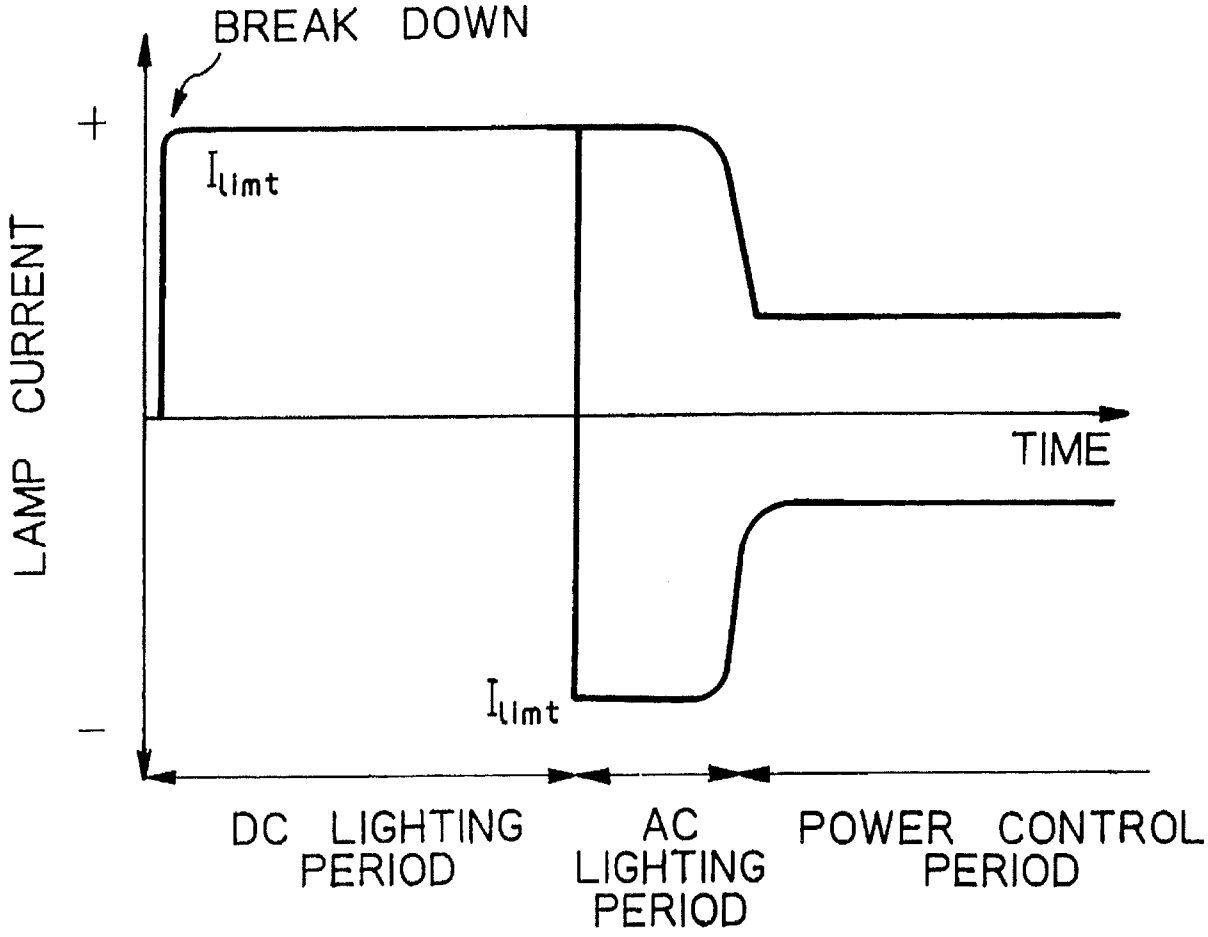
FIG. 6 shows a lamp current characteristics at starting according to the second embodiment.

FIG. 6 shows a lamp current characteristics at starting where the lamp current I is controlled based upon such the rectangular-wave lighting method and also controlled as $I \leqq I_{limt}$ according to the second embodiment.

Third Embodiment

Figure 7:
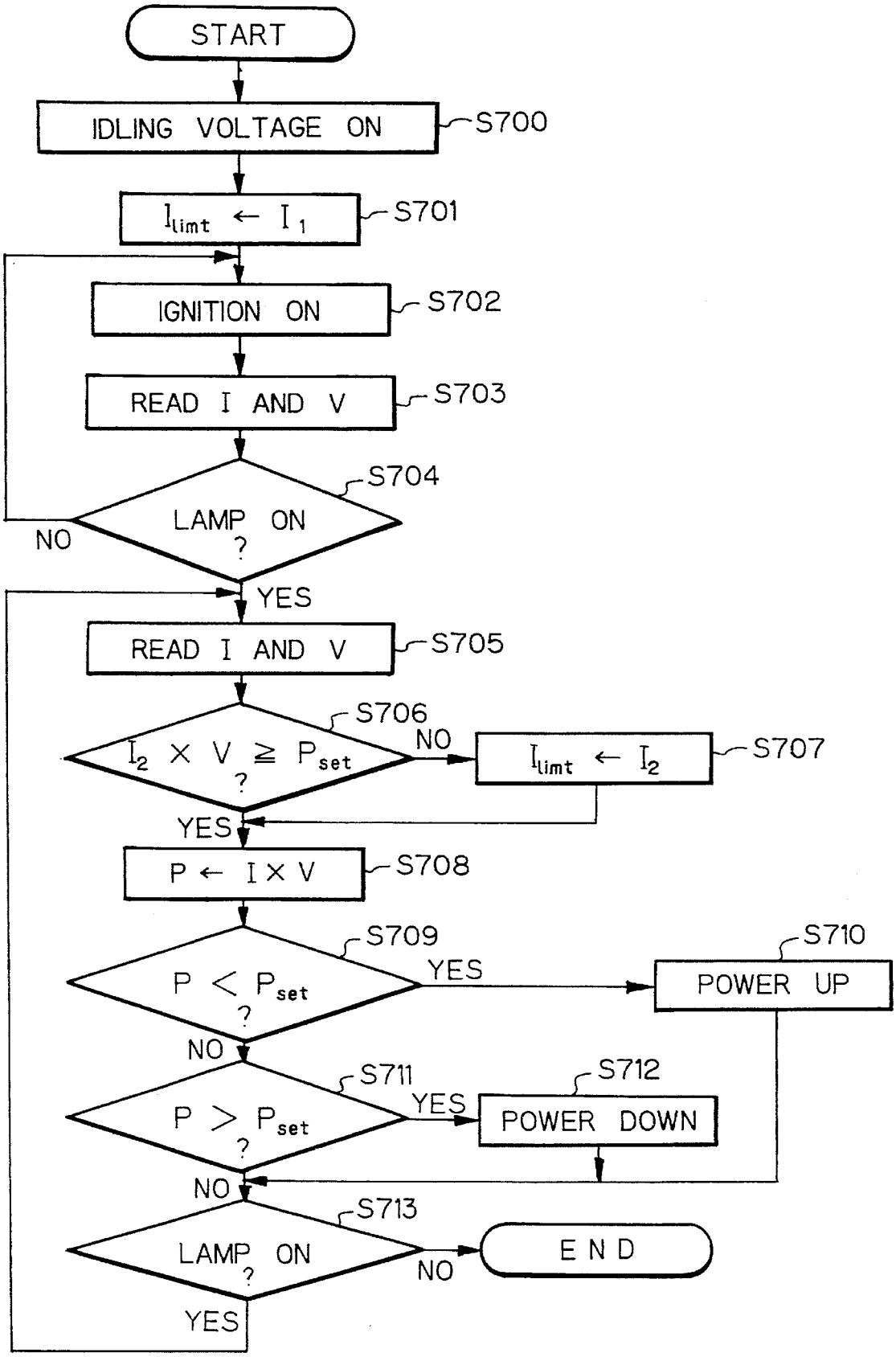
FIG. 7 shows a flow chart schematically representing a part of a control program of a microcomputer in a computer control circuit according to a third embodiment.

FIG. 7 shows a flow chart schematically representing a part of a control program of the microcomputer in a computer control circuit according to a third embodiment.

In this third embodiment, the circuit constitution of the discharge lamp lighting apparatus is the same as that of the first embodiment. Also, the operations at steps S700 and S702 to S705 and at steps S708 to S713 are substantially the same as that at the steps S400 to S404 and at the steps S405 to S410 in the first embodiment, respectively. Namely, in this embodiment, process at steps S701, S706 and S707 are newly added to the process in the first embodiment. Therefore, operations only at these additional steps will be described hereinafter.

At the step S701 which is next to the step S700 wherein idling voltage is applied to the lamp, a limiting value of the lamp current at starting $I_{limt}$ is initially set to a predetermined value $I_1$. This value $I_1$ should be determined so that the lamp power applied to the HID lamp 15 never exceed its maximum allowable power even if this lamp is hot-started. It should be noted that the computer control circuit 19 outputs a control command against the drive/control circuit 12 so that the output current from the DC/DC converter circuit 11 is to be regulated equal to or less than the limiting value $I_{limt}$ (in this case $I_{limt}=I_1$). In a modified example, the operation at the step S701 may be executed before the step S700.

At the step S706 which is next to the step S705 wherein an actual lamp current I and an actual lamp voltage V just after the lamp is lighted are inputted, the microcomputer judges whether the lamp 15 is hot-started or cold-started depending upon the inputted lamp voltage V just after starting. This judgment is carried out by comparing $I_2 \times V$ with $P_{set}$ or by comparing $I_2$ with $P_{set}/V$, where $I_2$ is the maximum allowable current of the lamp 15 and $P_{set}$ is a predetermined target value of the lamp power (for example, a nominal lamp power). It is judged that the lamp is hot-started when $I_2 \times V \geqq P_{set}$, and that the lamp is cold-started when $I_2 \times V < P_{set}$.

Only when the lamp is cold-started, the program will proceed to step S707 wherein the limiting value of the lamp current $I_{limt}$ is set to the maximum allowable current $I_2$ of the lamp. Namely, $I_{limt} \leftarrow I_2$ will be executed at the step S707. Thus, the computer control circuit 19 outputs a control command against the drive/control circuit 12 so that the output current from the DC/DC converter circuit 11 is to be regulated equal to or less than the limiting value $I_{limt}$ (in this case $I_{limt}=I_2$). Accordingly, the maximum limit of the output current from the DC/DC converter 11 is determined to the maximum allowable lamp current $I_2$ when cold-started wherein the lamp voltage is low. When hot-started, the maximum limit of the output current from the converter 11 is determined to the value $I_1$ ($I_1<I_2$) which is selected so that the lamp power never exceed the maximum allowable power even if the lamp is hot-started.

Figure 8A:
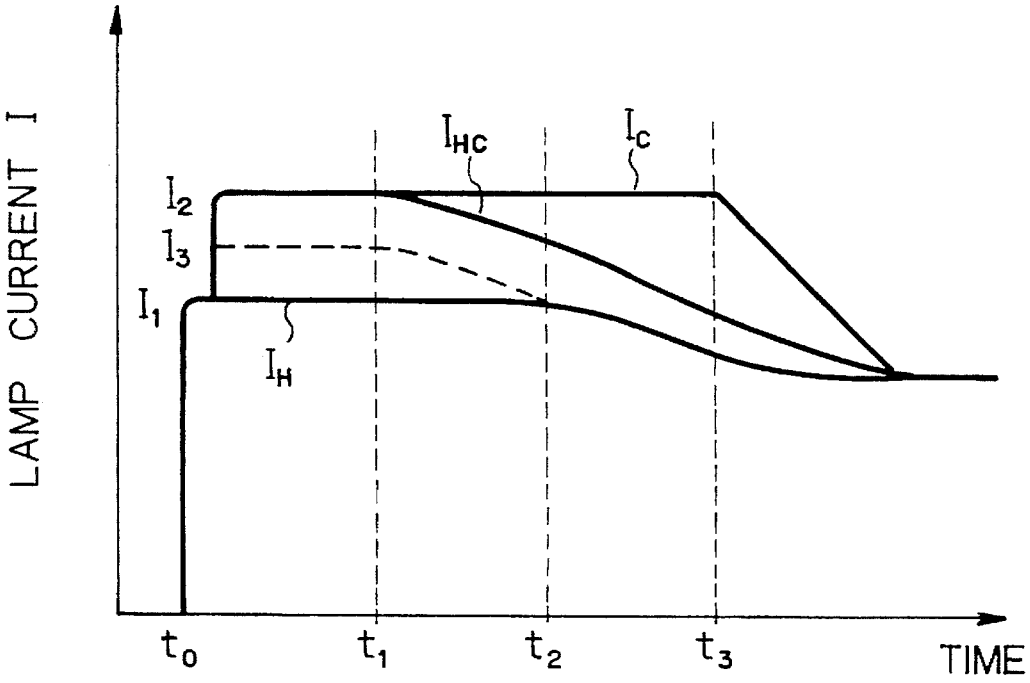
FIGS. 8*a* and 8*b* show variations of the lamp current and of the lamp power controlled by the third embodiment with respect to time, respectively.
Figure 8B:
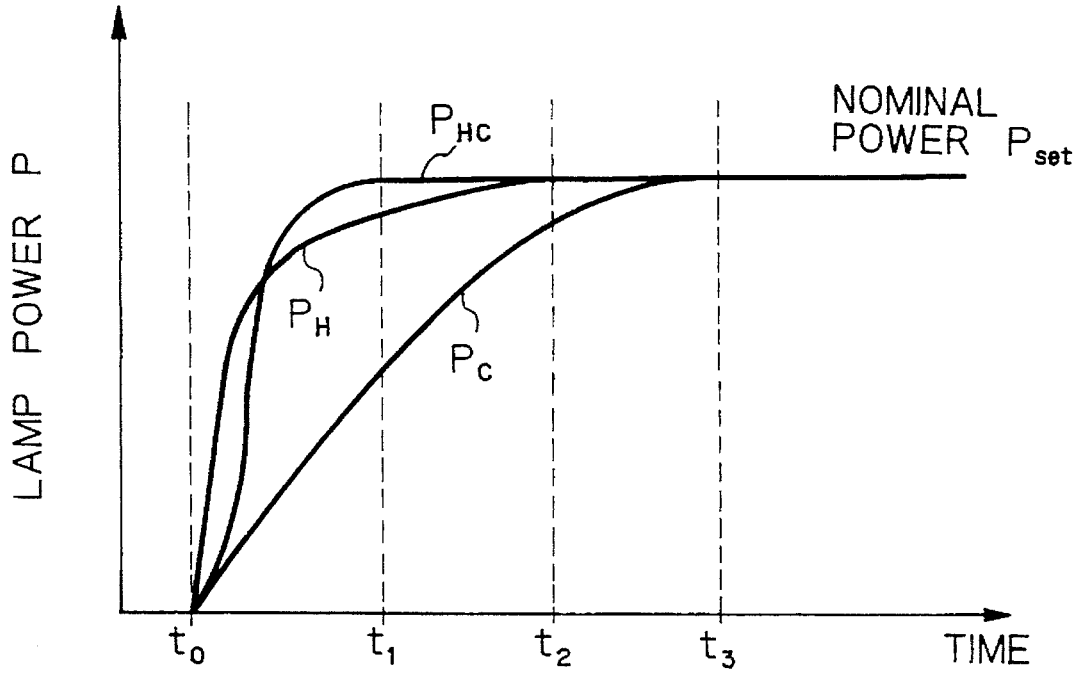

FIGS. 8*a* and 8*b* show variations of the lamp current and of the lamp power controlled by this embodiment with respect to time, respectively.

In these figures, $I_H$ and $P_H$ indicate a lamp current and a lamp power when the lamp is hot-started, $I_C$ and $P_C$ indicate a lamp current and a lamp power when the lamp is cold-started, and $I_{HC}$ and $P_{HC}$ indicate a lamp current and a lamp power when the lamp is started in a medium condition between the hot-start and cold-start conditions.

The lamp current $I_H$ at the hot-start condition is limited to the value $I_1$, and thus $I_H$ will be kept at $I_1$ until time $t_2$, as shown in FIG. 8*a*. After time $t_2$, since the lamp voltage will gradually increase with growth of arc discharge in the lamp and thus the calculated lamp power P will exceed the target value $P_{set}$, the lamp current $I_H$ is controlled by the aforementioned power control process to gradually reduce until the arc discharge becomes stable. Thus, as shown in FIG. 8*b*, the lamp power $P_H$ can be regulated to saturate at the nominal lamp power $P_{set}$ after the time $t_2$.

At the cold-start condition, the lamp current $I_C$ is limited to the value $I_2$ which is greater than $I_1$, and therefore $I_C$ will be kept at $I_2$ until time $t_3$, as shown in FIG. 8*a*. After time $t_3$, since the lamp voltage will gradually increase with growth of arc discharge in the lamp and thus the calculated lamp power P will exceed the target value $P_{set}$, the lamp current $I_C$ is controlled by the power control process to gradually reduce until the arc discharge becomes stable. Thus, as shown in FIG. 8*b*, the lamp power $P_C$ can also be regulated to saturate at the nominal lamp power $P_{set}$ after the time $t_3$.

At the medium-start condition between the hot-start and cold-start conditions, the lamp current $I_{HC}$ is limited to the value $I_2$, and therefore $I_{HC}$ will be kept less than $I_2$ until time $t_1$, as shown in FIG. 8*a*. After time $t_1$, since the lamp voltage will gradually increase with growth of arc discharge in the lamp and thus the calculated lamp power P will exceed the target value $P_{set}$, the lamp current $I_{HC}$ is controlled by the aforementioned power control process to gradually reduce and therefore, as shown in FIG. 8*b*, the lamp power $P_{HC}$ can be regulated to saturate at the nominal lamp power $P_{set}$.

According to this third embodiment of the present invention, since the upper limit of the lamp current is set to $I_1$ at hot-start condition and to $I_2$ at cold-start condition, lighting control at starting can be conducted by an adaptive lamp current depending upon actual temperature of the discharge lamp 15. In other words, damages on the discharge lamp such as melting of lamp electrodes caused by excess power input at the hot-start condition can be prevented from occurring without protracting starting time period of the lamp at the cold-start condition or without going out the lamp at the cold-start condition. Since excess power will not applied to the lighting control apparatus itself at the hot-start condition, its internal circuits will not be damaged and also breakers or fuses provided in or out of the lighting control apparatus will not operate in error. Furthermore, according to this embodiment, as the lamp voltage just after lighting is detected and the detected lamp voltage is used for the aforementioned lamp power control, excess power will not be applied to the lamp even if individual lamp voltages of the respective discharge lamps are scattered.

As will be apparent that this embodiment can be adapted any of lighting equipments using HID lamps, for example, HID lamps for automobile head lights. However, this embodiment may be particularly advantageous for lighting equipments such as optical projection equipments which are repeatedly turned on and off and thus are frequently lighted at the hot-start condition.

Fourth Embodiment

Figure 9:
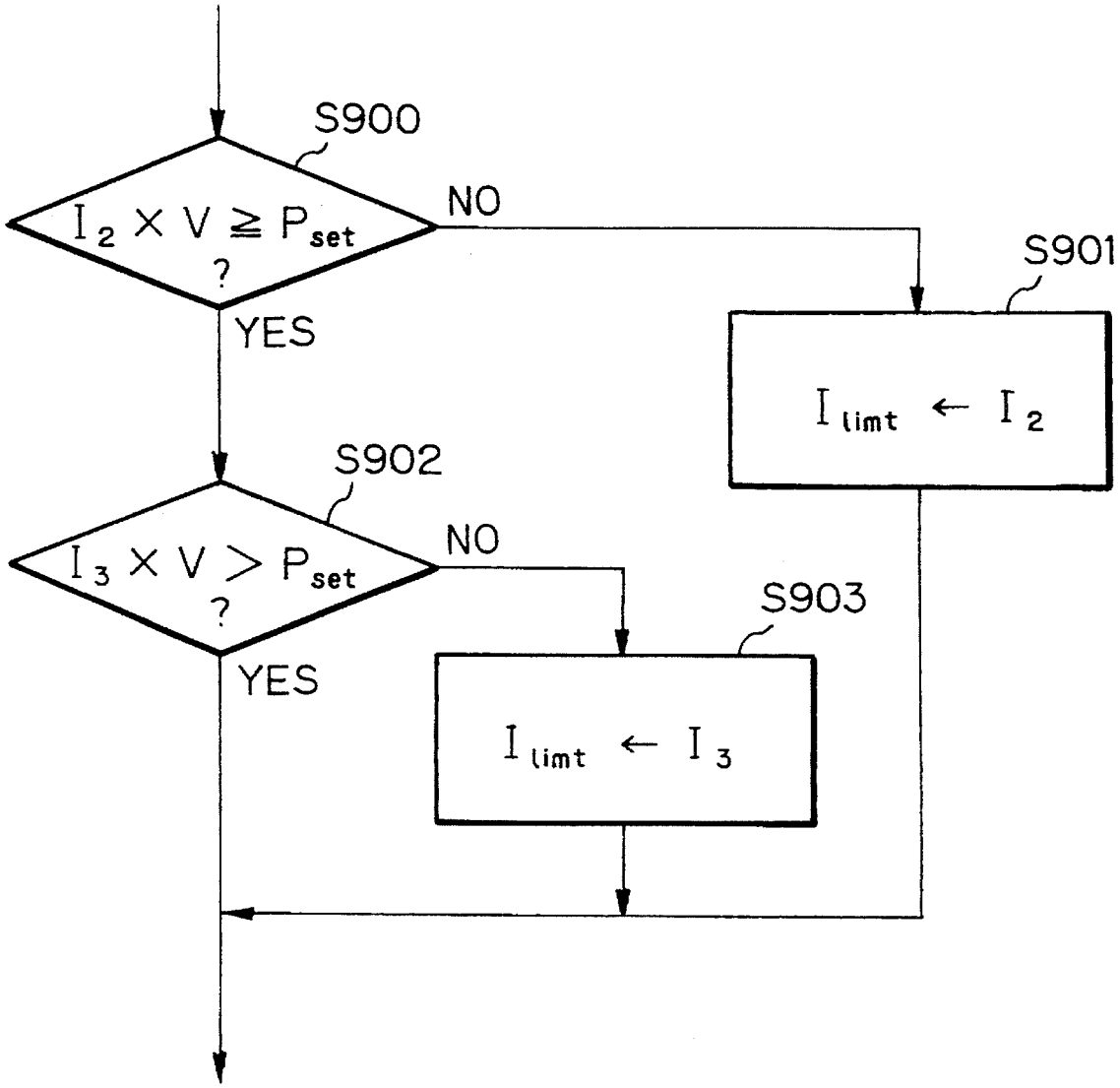
FIG. 9 shows a flow chart schematically representing a part of a control program of a microcomputer in a computer control circuit according to a fourth embodiment.

FIG. 9 shows a flow chart schematically representing a part of a control program of the microcomputer in a computer control circuit according to a fourth embodiment.

In this fourth embodiment, the circuit constitution of the discharge lamp lighting apparatus is the same as that of the first embodiment. Also, the control program in this embodiment is the same as that in the third embodiment except that process at steps S900 to S903 are executed instead of that at the steps S706 and S707 in the third embodiment. Namely, although the limiting value of the lamp current is selected from two values of $I_1$ and $I_2$ in the third embodiment, the limiting value can be selected from three values of $I_1$, $I_2$ and $I_3$ in this fourth embodiment. Hereinafter, operations only at these additional steps will be described.

At the step S900 which is next to the step corresponding to the step S705 in the third embodiment, wherein an actual lamp current I and an actual lamp voltage V just after the lamp is lighted are inputted, the microcomputer judges whether the lamp 15 is hot-started (or medium-started which is a medium state between the hot-start and cold-start conditions) or cold-started depending upon the inputted lamp voltage V just after starting. This judgment is carried out by comparing $I_2 \times V$ with $P_{set}$ or by comparing $I_2$ with $P_{set}/V$, where $I_2$ is the maximum allowable current of the lamp 15 and $P_{set}$ is a predetermined target value of the lamp power (for example, a nominal lamp power). It is judged that the lamp is hot-started or medium-started when $I_2 \times V \geqq P_{set}$, and that the lamp is cold-started when $I_2 \times V < P_{set}$.

Only when the lamp is cold-started, the program will proceed to step S901 wherein the limiting value of the lamp current at starting $I_{limt}$ is set to the maximum allowable current of the lamp $I_2$. Namely, $I_{limt} \leftarrow I_2$ will be executed at the step S901. Thus, the computer control circuit 19 outputs a control command against the drive/control circuit 12 so that the output current from the DC/DC converter circuit 11 is to be regulated equal to or less than the limiting value $I_{limt}$ (in this case $I_{limt}=I_2$).

When $I_2 \times V \geqq P_{set}$, the program proceeds to the step S902 wherein the microcomputer Judges whether the lamp is hot-started or medium-started. This judgment is carried out by comparing $I_3 \times V$ with $P_{set}$ or by comparing $I_3$ with $P_{set}/V$, where $I_3$ is the current between $I_1$ and $I_2$. It is judged that the lamp is hot-started when $I_3 \times V > P_{set}$, and that the lamp is medium-started when $I_3 \times V \leqq P_{set}$.

Only when the lamp is medium-started, the program will proceed to step S903 where the limiting value of the lamp current $I_{limt}$ is set to the medium value $I_3$. Namely, $I_{limt} \leftarrow I_3$ will be executed at the step S903. Thus, the computer control circuit 19 outputs a control command against the drive/control circuit 12 so that the output current from the DC/DC converter circuit 11 is to be regulated equal to or less than the limiting value $I_{limt}$ (in this case $I_{limt}=I_3$).

Accordingly, the maximum limit of the output current from the DC/DC converter 11 is determined to the maximum allowable lamp current $I_2$ when cold-started wherein the lamp voltage is low. When hot-started, the maximum limit of the output current from the converter 11 is determined to the value $I_1$ ($I_1<I_2$) which is selected so that the lamp power never exceed the maximum allowable power even if the lamp is hot-started. When medium-started which is a medium state between the hot-start and cold-start conditions, the maximum limit of the output current from the converter 11 is determined to the value $I_3$ which is between $I_1$ and $I_2$, as shown by a broken line in FIG. 8*a*.

According to this fourth embodiment of the present invention, since the upper limit of the lamp current is set to $I_1$ at hot-start condition, to $I_3$ at medium-start condition, and to $I_2$ at cold-start condition, lighting control at starting can be conducted by an adaptive lamp current depending upon actual temperature of the discharge lamp 15. Particularly, even in case that the difference between $I_1$ and $I_2$ is great (this may occur, for example, in case the nominal lamp power is relatively high), an adaptive detail control depending upon the actual temperature state of the lamp can be expected without protracting starting time period of the lamp or going out the lamp at the medium-start condition. Another advantages of this embodiment are the same as these of the third embodiment.

In this embodiment, the limiting value of the lamp current at starting $I_{limt}$ is selected from three values. However, according to the present invention, it can be selected from four or more values.

Fifth Embodiment

Figure 10:
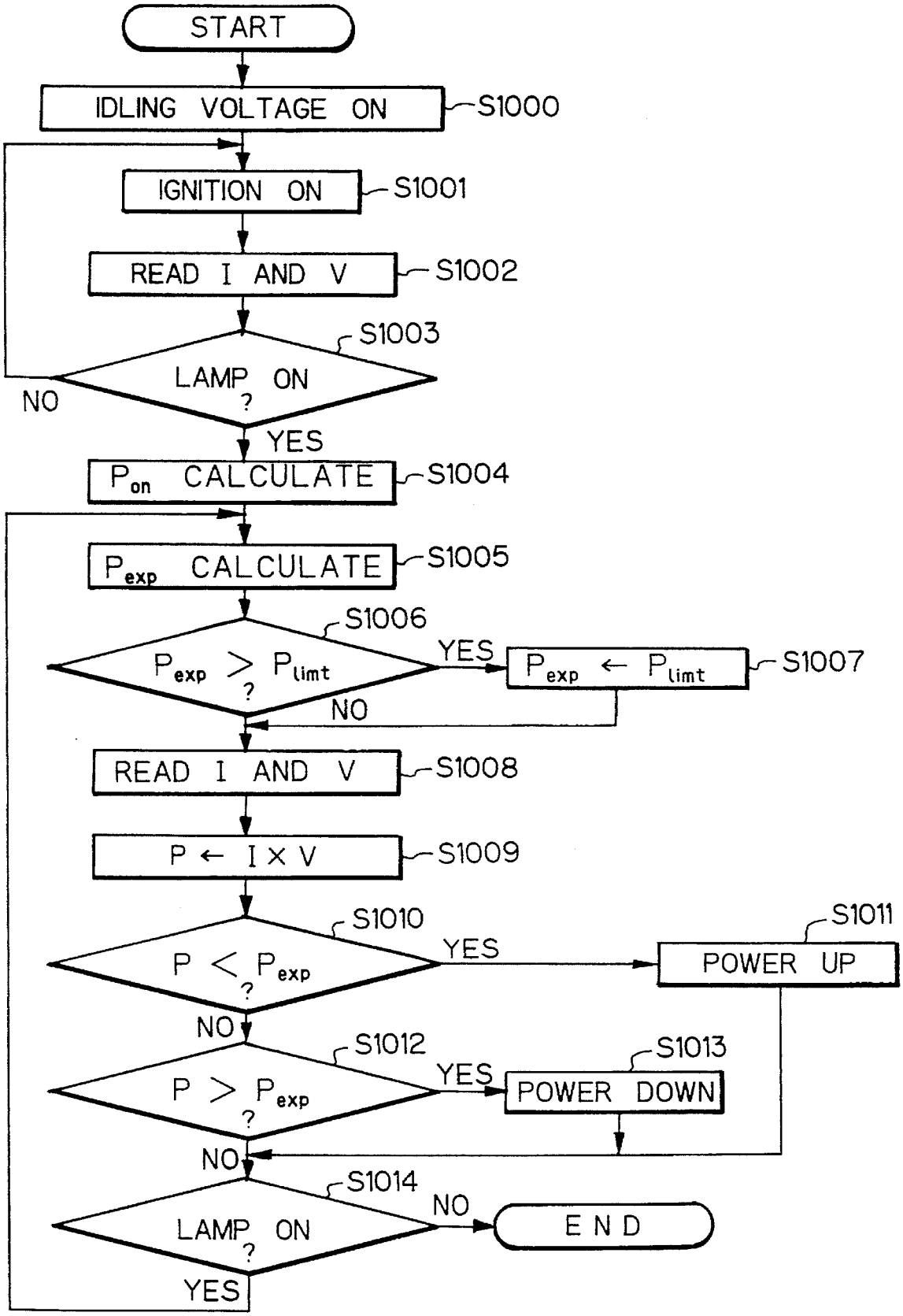
FIG. 10 shows a flow chart schematically representing a part of a control program of the microcomputer in a computer control circuit according to a fifth embodiment.

FIG. 10 shows a flow chart schematically representing a part of a control program of the microcomputer in a computer control circuit according to a fifth embodiment.

In this fifth embodiment, the circuit constitution of the discharge lamp lighting apparatus is the same as that of the first embodiment. Also, the operations at steps S1000 to S1003 and at steps S1008 to S1014 are substantially the same as that at the steps S400 to S403 and at the steps S404 to S410 in the first embodiment, respectively. Namely, in this embodiment, process at steps S1004 to S1007 are newly added to the process in the first embodiment. Therefore, operations only at these additional steps will be described hereinafter.

At the step S1004 which is next to the step S1003 wherein the microcomputer 19 judges whether the lamp 15 is lighted or not, an initial lamp power $P_{on}$ at starting is calculated by using the following approximate equation;

$$P_{on}=(P_m-P_{off})\times(1-e^{-T_{off}/\beta})+P_{off}$$

where $P_{off}$ is a last lamp power just before the lamp was lighted out at last time, which lamp power has been stored in a memory in the microcomputer, $T_{off}$ is a time period of the last lights-out (light-off period) counted by a timer in the microcomputer in response to an on/off detection signal produced by on/off operation of the lighting switch (not shown), $P_m$ is the maximum lamp power at starting in cold-start condition (constant), and $\beta$ is a constant determined in accordance with characteristics of the lamp and its reflector.

Then, at the next step S1005, an expected lamp power after lighting $P_{exp}$ is calculated by using the following approximate equation;

$$P_{exp}=(P_{on}-P_{set})\times e^{-T_{on}/\alpha}+P_{set}$$

where $T_{on}$ is a time period of lighting (light-on period) counted by a timer in the microcomputer in response to the on/off detection signal, $P_{set}$ is a nominal lamp power, and $\alpha$ is a constant determined in accordance with characteristics of the lamp and its reflector.

Then, at the step S1006, the microcomputer judges whether the calculated $P_{exp}$ exceeds the maximum allowable lamp power $P_{limt}$ which was predetermined when the lamp was designed. Only when $P_{exp}>P_{limt}$, the program proceeds to the step S1007 wherein the process of $P_{exp}\leftarrow P_{limt}$ is executed. Thus, the target lamp power $P_{exp}$ is regulated equal to or less than $P_{limt}$. Thereafter, at the steps S1008 to S1014, processes of controlling the actual lamp power P to the expected lamp power $P_{exp}$ are executed.

Accordingly, the lamp power P supplied to the HID lamp 15 will be initially controlled to approach $P_{on}$ and then controlled to approach $P_{exp}$. The controlled lamp power P is stored in the memory in the microcomputer and this value P is repeatedly renewed while the lighting switch (not shown) is kept on. Therefore, the last renewed value P stored in the memory is handled as the last lamp power $P_{off}$ just before the lamp was lighted out.

To the computer control circuit 19 of course backup power is supplied. Therefore, the microcomputer can execute backup operation for maintaining data stored in its memory and also counting operation for measuring the light-off period $T_{off}$ even when the lighting switch is kept off. In addition, by supplying backup power, the microcomputer can be maintained in a standby condition causing its rise time and therefore rise time of lamp luminous flux when the switch is turned on to shorten.

Figure 11:
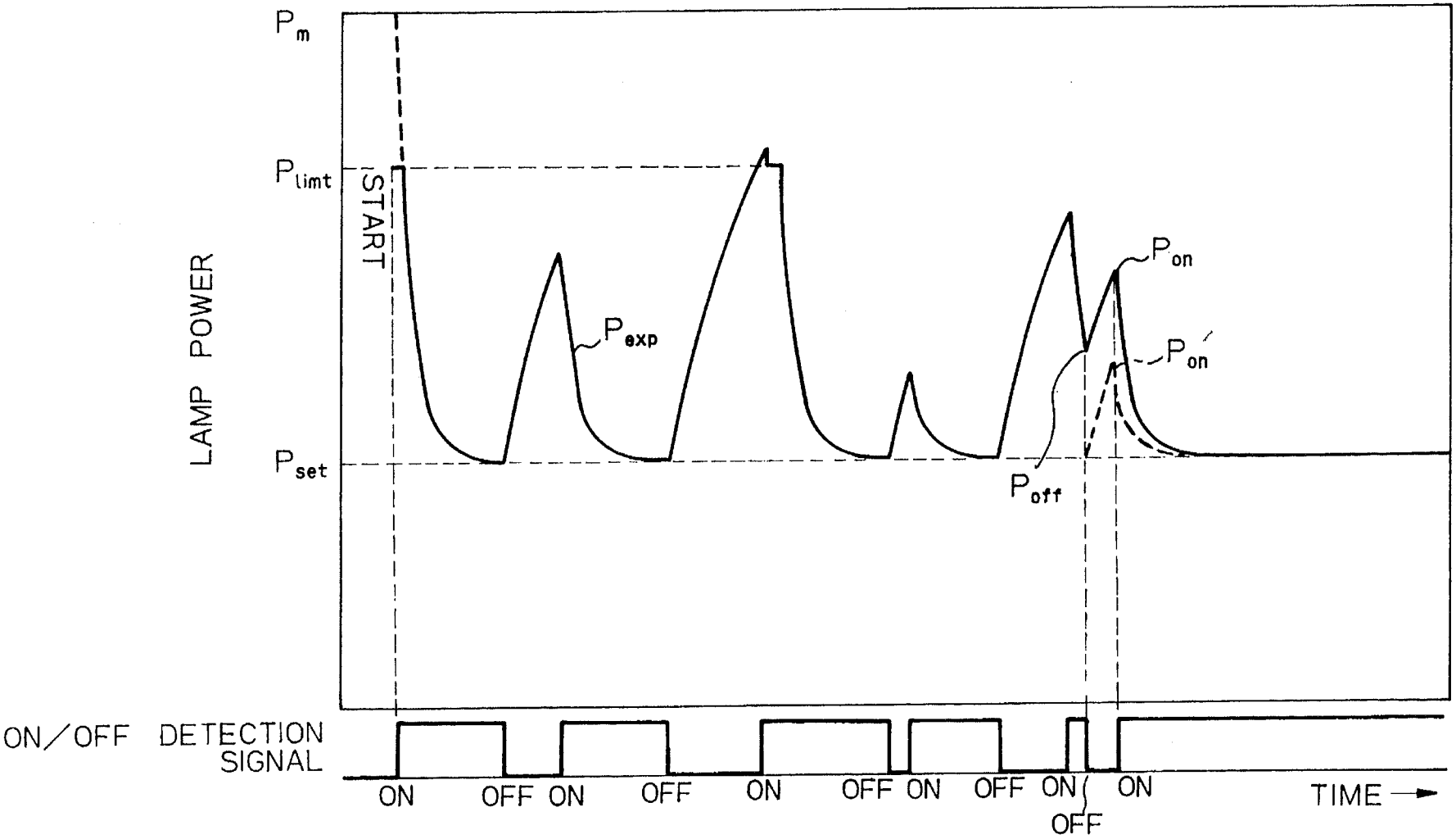
FIG. 11 shows the on/off detection signals and variations of the lamp powers with respect to time, according to the fifth embodiment.

FIG. 11 shows variations of the initial and expected lamp powers $P_{on}$ and $P_{exp}$ and the on/off detection signals supplied to the control circuit 19, with respect to time.

As seen in this figure, when the lamp is cold-started, the lamp power starts from the limited value $P_{limt}$ not from the maximum lamp power at starting $P_m$. This is because the lamp power $P_{exp}$ therefore $P_{on}$ is regulated to $P_{limt}$. After lighting, the actual lamp power P is controlled by the process at the steps S1008 to S1013 so that P approaches to $P_{exp}$ and finally is saturated to the nominal lamp power $P_{set}$. If the light-off period is short, namely at the hot-start condition or at the medium-start condition, since the initial lamp power $P_{on}$ is calculated depending upon the last lamp power and upon the light-off period, the lamp will be started at a lamp power lower than $P_{limt}$.

Suppose a case that the light-on period is short and the following light-off period is also short, namely that the light switch is turned off just after the last turning on and then turned on again just after the turning off. In such the case, if the initial lamp power is determined depending upon only the light-off period, the determined initial lamp power $P_{on}$, will be low, as indicated by a broken line in FIG. 11, causing the lamp not to light or causing rise time of the lamp luminous flux to make longer even it is lighted. However, according to this embodiment, since the initial lamp power is calculated depending upon not only the light-off period $T_{off}$ but also the last lamp power $P_{off}$, the calculated power $P_{on}$ will become relatively high as indicated in FIG. 11, even in the above-mentioned case. This will provide extremely short rise time of luminous flux of the lamp.

Namely, according to this fifth embodiment of the present invention, since starting lamp power is controlled by seizing the actual condition of the lamp depending upon both the last lamp power just before lighting out $P_{off}$ and the light-off period $T_{off}$, the lamp can be started with enough lamp power even in a case the light-on period is short and the following light-off period is also short. Thus, the lamp can be certainly lighted and rapid rise of the lamp flux can be expected. Another advantages of this embodiment are the same as these of the first embodiment.

Sixth Embodiment

Figure 12:
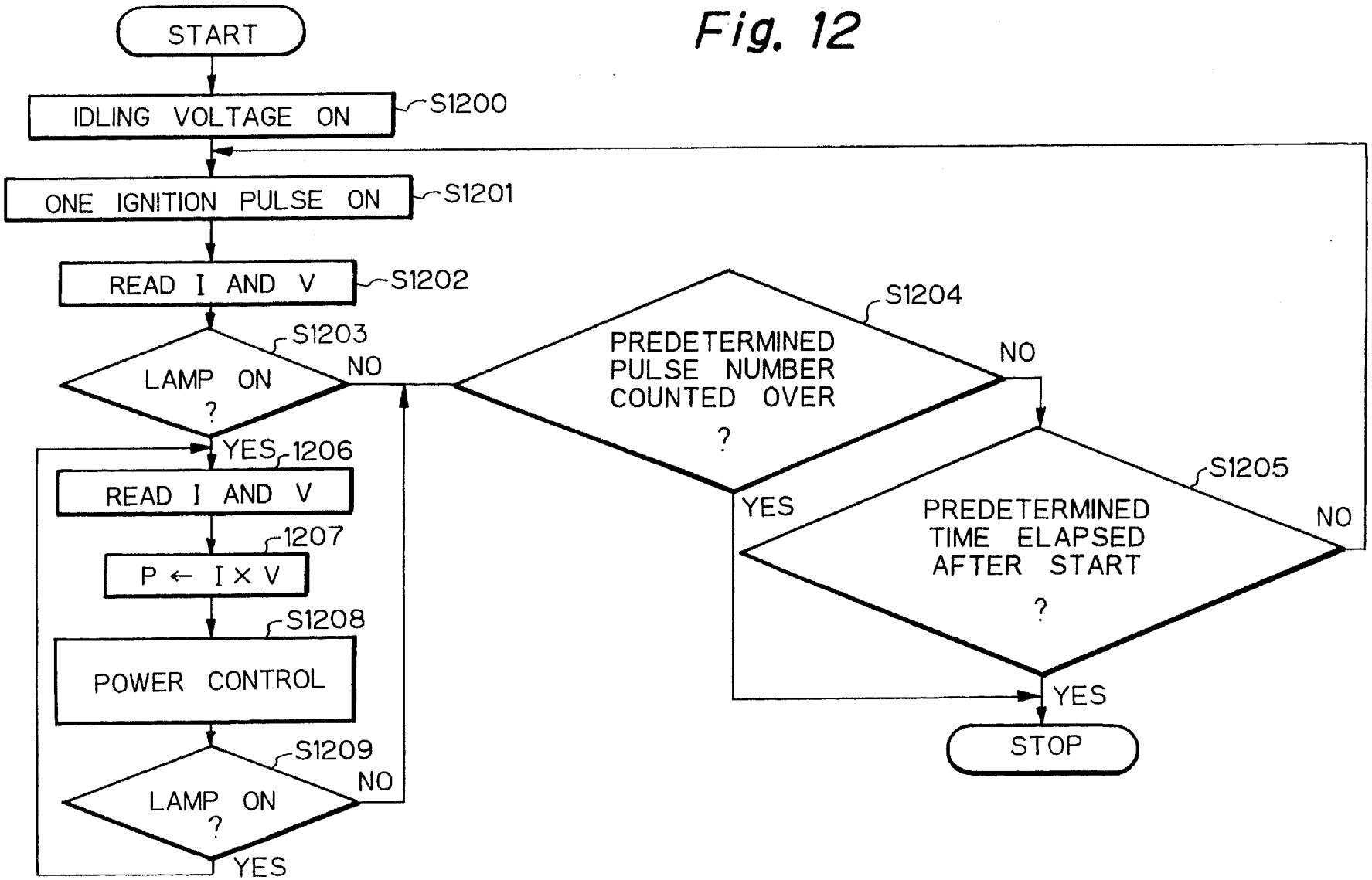
FIG. 12 shows a flow chart schematically representing a part of a control program of a microcomputer in a computer control circuit according to a sixth embodiment.

FIG. 12 shows a flow chart schematically representing a part of a control program of the microcomputer in a computer control circuit according to a sixth embodiment. The control program in this embodiment can check a lighting error so as to detect troubles in the HID lamp or in the lighting apparatus itself at starting.

In this sixth embodiment, the circuit constitution of the discharge lamp lighting apparatus is the same as that of the first embodiment. Also, the operations at steps S1200 to S1203 are substantially the same as that at the steps S400 to S403 in the first embodiment except that only one ignition pulse is produced at the step S1201. Furthermore, the operations at steps S1206 to S1209 are quite the same as that at the steps S404 to S410 in the first embodiment. In this embodiment, process at steps S1204 and S1205 are newly added to the process in the first embodiment. Therefore, operations at these additional steps and at steps related to these additional steps will be mainly described hereinafter.

At the step S1201, as mentioned before, the control circuit 19 outputs a control signal to the drive circuit 18 so that the ignition pulse circuit 17 outputs only one cycle trigger pulse with high voltage of for example 15 kV is produced across the secondary winding of the transformer 16. Thus, in general, break down will occur in the HID lamp 15 to produce a glow discharge. Then, this glow discharge will glow up to arc discharge resulting lighting-up of the lamp.

The control circuit 19 then takes in a current signal which represents the lamp current via the amplifier 20 and a voltage signal which represents the lamp voltage at step S1202. These current signal and voltage signal are converted into a digital current signal I and a digital voltage signal V, respectively, by A/D converters in the control circuit 19.

At the next step S1203, the microcomputer 19 judges whether the lamp 15 is lighted or not by comparing the lamp current I with a predetermined threshold value $I_{on}$ or by comparing the lamp voltage V with a predetermined threshold value $V_{off}$. If $I>I_{on}$ or $V<V_{off}$, it is judged that the lamp is lighted up and the program directly proceeds to the step S1206 for carrying out the lamp power control.

If it is judged that the lamp is not lighted, the program proceeds to the step S1204. At this step S1204, the microcomputer judges whether the number of the repeatedly produced ignition pulses, namely the repeated number of the operation at the step S1201, exceeds a predetermined number or not. If the number does not exceed the predetermined number, the program proceeds to the step S1205 wherein whether a predetermined time period has been elapsed after start or not is judged. If not elapsed, the program returns again to the step S1201 and applies a next ignition pulse to the lamp.

In case the number of the repeatedly produced ignition pulses exceeds the predetermined number (step S1204), or in case the time period after start elapsed (step S1205), it is judged that the HID lamp and/or the lighting apparatus itself malfunction, resulting the computer control circuit 19 to output a control command to the drive/control circuit 12 so as to stop the power supplying operation from the DC/DC converter circuit 11. Thus, the lighting control process is suspended.

Steps S1206 to S1209 are process of controlling lamp power to a target lamp power (generally corresponding to a nominal lamp power). Operation at the step S1208 corresponds to that at the steps S406 to S409 in the first embodiment.

According to this sixth embodiment of the present invention, the computer control circuit 19 checks in real time whether the lamp is lighted up or not at each time one ignition pulse with high voltage being produced, and then if it is lighted up, the lamp power control at starting is immediately executed without producing next ignition pulse. Thus, only the minimum necessary number of high voltage ignition pulses will be supplied to the lamp causing safety operation of the lighting apparatus and the HID lamp to extremely improve.

It should be noted that the above-mentioned ignition pulse control and real time check of lighting of the HID lamp at each ignition pulse production can be realized only by using a microcomputer. Namely, the lighting process control using a microcomputer permits detail process control of the HID lamp even if the lighting control apparatus has very simple constitution. This causes the HID lamp lighting apparatus to downsize and to manufacture with a lower cost.

Furthermore, according to this embodiment, since a next ignition pulse is immediately applied to the lamp when going out of the lamp is detected, a metal halide lamp which is relatively difficult to start can be certainly lighted up. Another advantages of this embodiment are the same as these of the first embodiment.

Seventh Embodiment

Figure 13:
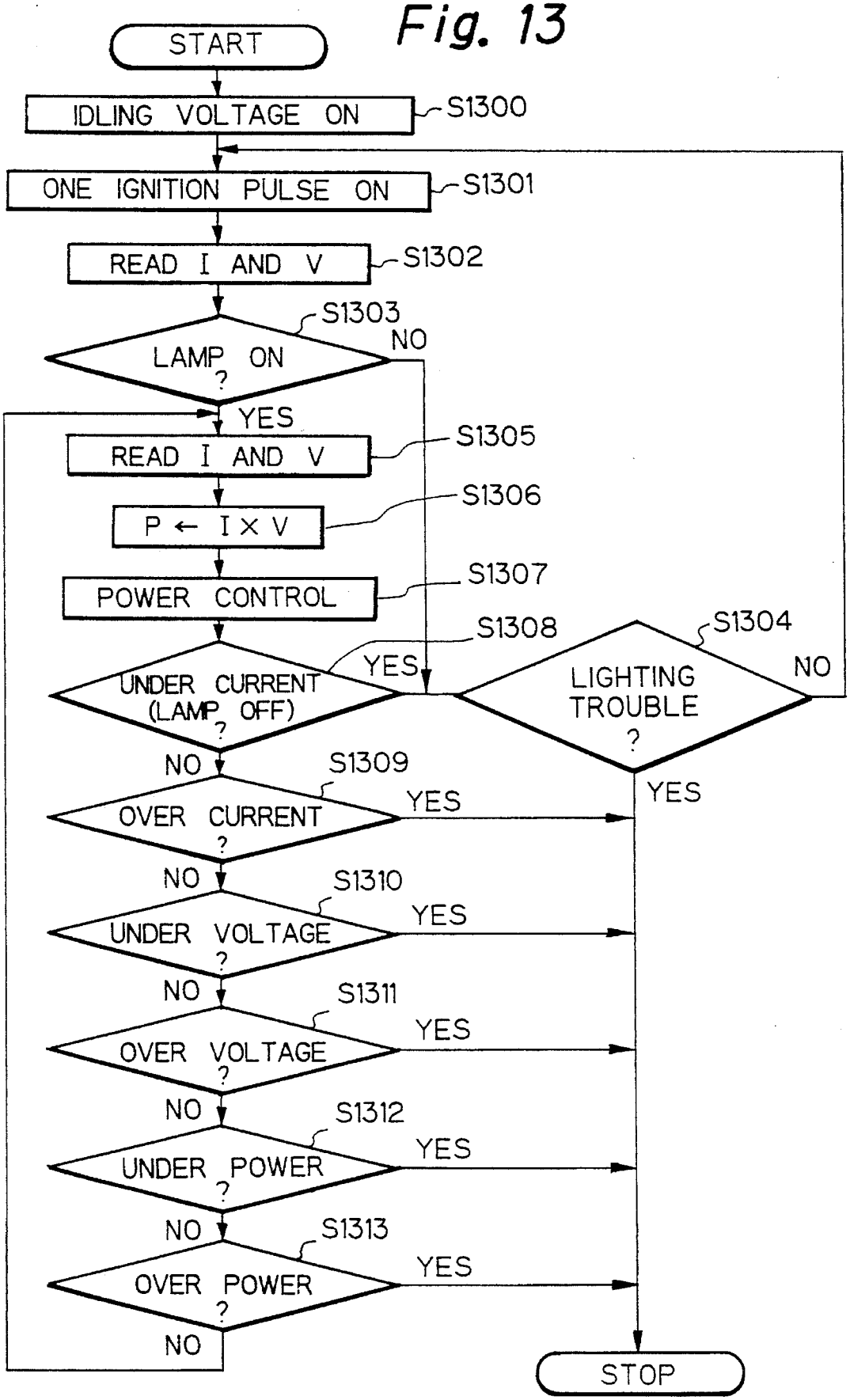
FIG. 13 shows a flow chart schematically representing a part of a control program of a microcomputer in a computer control circuit according to a seventh embodiment.

FIG. 13 shows a flow chart schematically representing a part of a control program of the microcomputer in a computer control circuit according to a seventh embodiment. The control program in this embodiment can check not only a lighting error but also over current, over voltage and over power so as to detect troubles of the HID lamp or the lighting apparatus itself.

In this seventh embodiment, the circuit constitution of the discharge lamp lighting apparatus is the same as that of the first embodiment. Also, the operations at steps S1300 to S1308 are substantially the same as that at the steps S1200 to S1209 in the sixth embodiment. Namely, in this embodiment, process at steps S1309 to S1313 are newly added to the process in the sixth embodiment. Therefore, operations at these additional steps and at steps related to these additional steps will be mainly described hereinafter. It should be noted that the step S1304 in this seventh embodiment corresponds to the steps S1204 and S1205 in the sixth embodiment.

At the step S1308, the microcomputer 19 compares the lamp current I with a lower threshold current $I_{under}$. If $I<I_{under}$, it is judged that the lamp 15 is not lighted and the program proceeds to the step S1304 wherein the same processes for detecting a lighting trouble as that at the steps S1204 and S1205 in the sixth embodiment are executed. If $I \geqq I_{under}$, it is judged that the lamp is lighted up and the program proceeds to the next step S1309.

At the step S1309, the microcomputer 19 compares the lamp current I with an upper threshold current $I_{over}$. If $I>I_{over}$, it is judged that over current is inputted to the lamp 15 and the computer control circuit 19 outputs a control command to the drive/control circuit 12 so as to stop the power supplying operation from the DC/DC converter circuit 11, resulting the lighting control process to be suspended. If $I \leqq I_{over}$, the program proceeds to the next step S1310.

Similar processes are executed at the steps S1310 to S1313 by comparing the lamp voltage V with a lower threshold voltage $V_{under}$ and with an upper threshold voltage $V_{over}$, and by comparing the lamp power P with a lower threshold power $P_{under}$ and with an upper threshold power $P_{over}$, respectively.

Figure 14A:
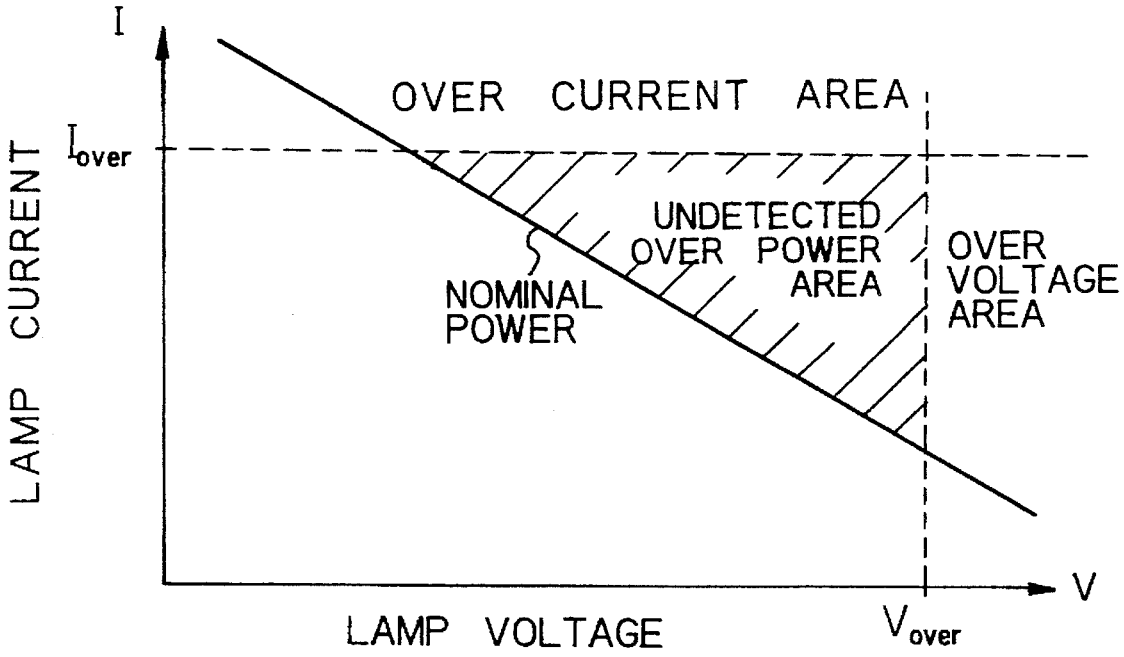
FIGS. 14*a* and 14*b* show voltage-current characteristics of the HID lamp according to a conventional lighting apparatus and the lighting apparatus of the seventh embodiment, respectively.
Figure 14B:
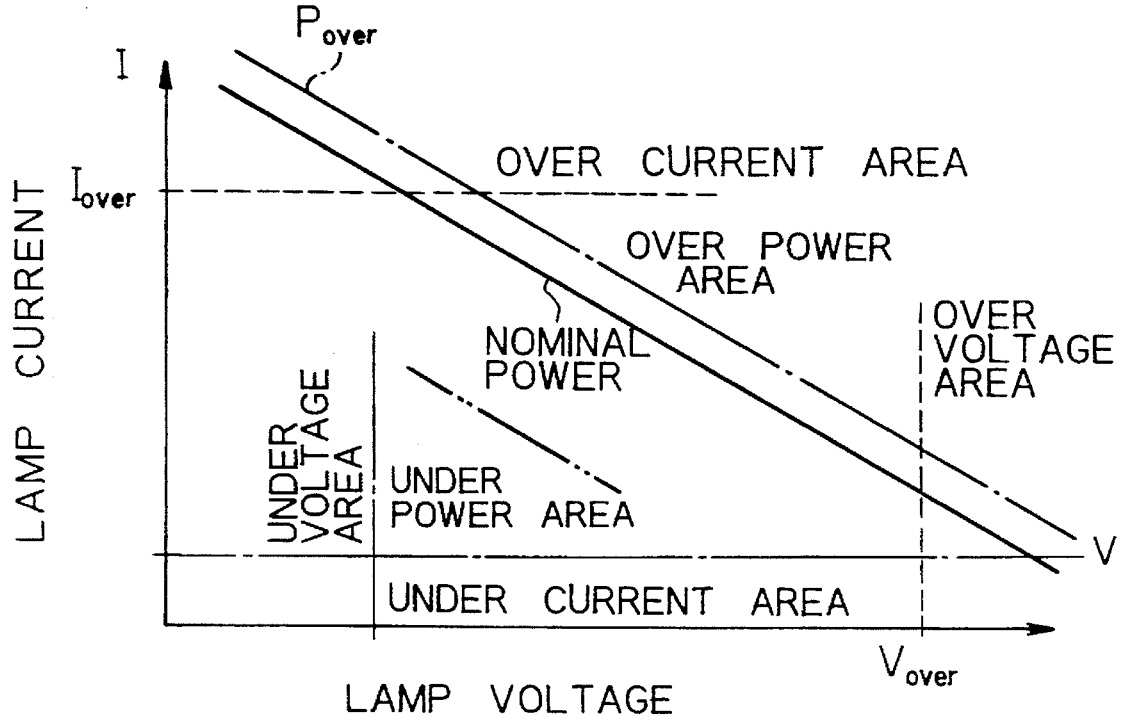

FIGS. 14*a* and 14*b* show voltage-current characteristics of the HID lamp according to a conventional lighting apparatus and the lighting apparatus of this seventh embodiment, respectively.

As shown in FIG. 14*a*, since the conventional lighting control apparatus checks individual two parameters of over current and over voltage in order to stop the power supply to the HID lamp, the over power area indicated by hatching cannot be detected. If the lamp is operated in this undetected over power area, its life will be shortened and in the worst case the lamp may be damaged. However, according to this embodiment, as shown in FIG. 14*b*, since over power is additionally checked for controlling the stoppage of the power supply to the lamp, any over power operation including that in the above-mentioned undetected over power area can be detected to stop the power supply. Therefore, the aforementioned disadvantages concerning the lamp life and damage against the lamp can be effectively prevented. Another advantages of this embodiment are the same as these of the sixth embodiment.

Eighth Embodiment

Figure 15:
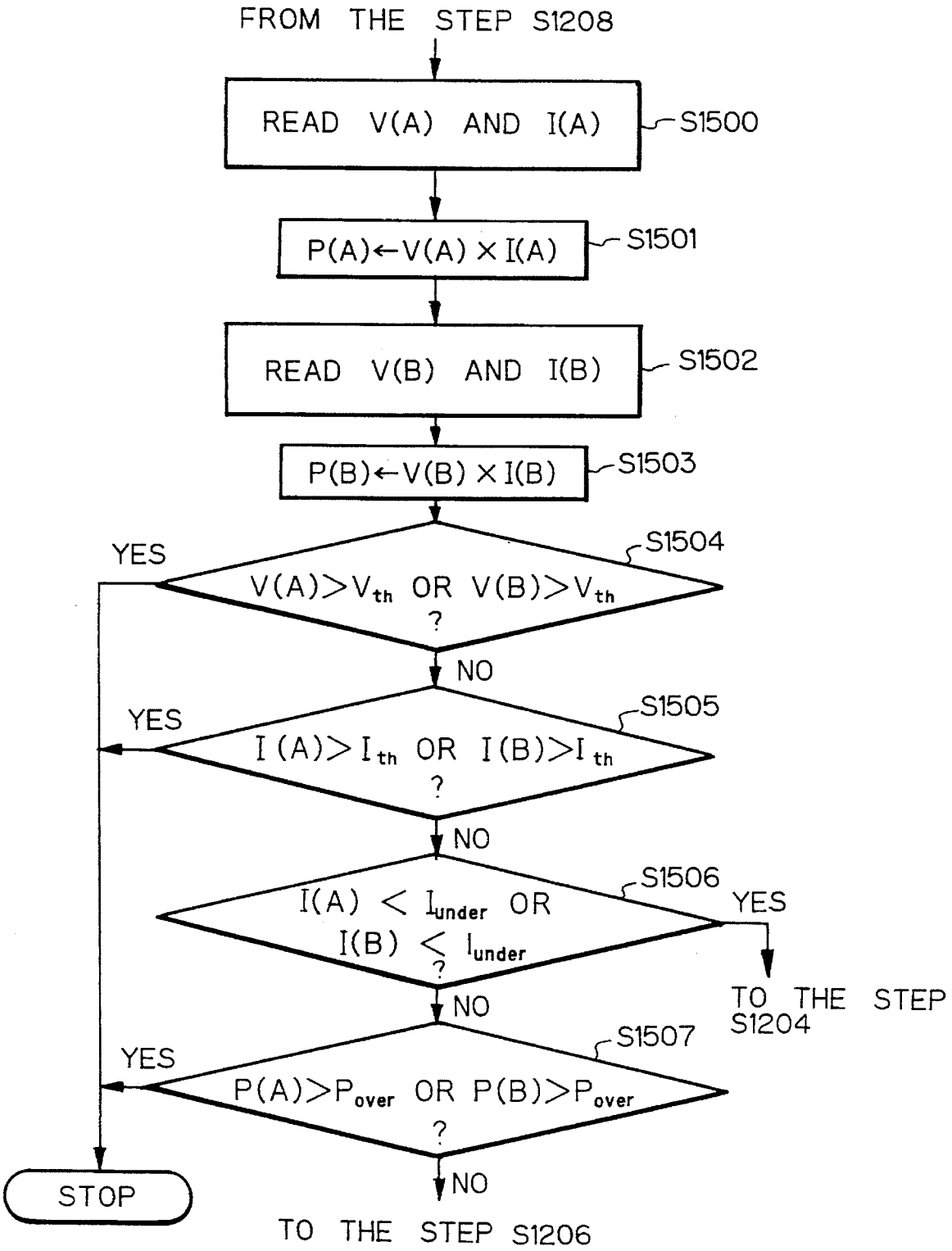
FIG. 15 shows a flow chart schematically representing a part of a control program of a microcomputer in a computer control circuit according to an eighth embodiment.
Figure 16A:
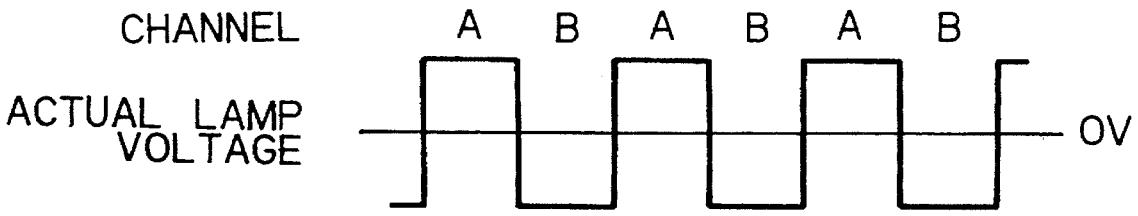
FIGS. 16 to 18 illustrate relationships between actual lamp voltage and current, detected lamp voltage and current, and calculated lamp power, according to the eighth embodiment.
Figure 16B:
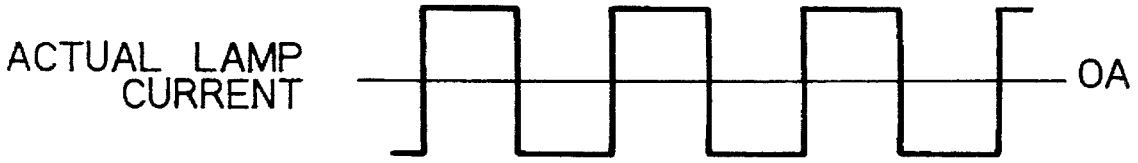
Figure 16C:
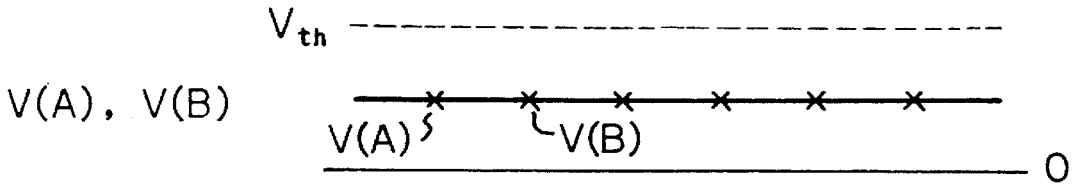
Figure 16D:
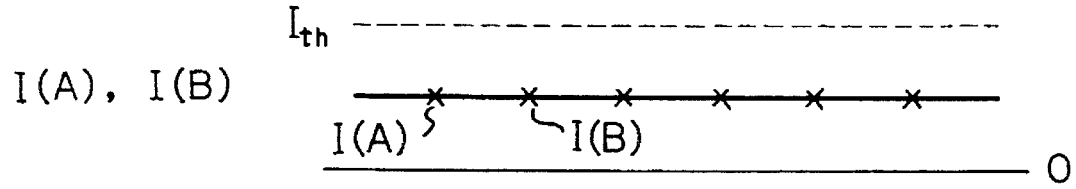
Figure 16E:
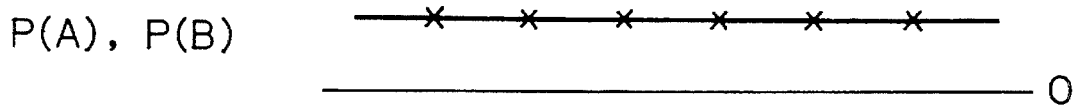
Figure 17A:
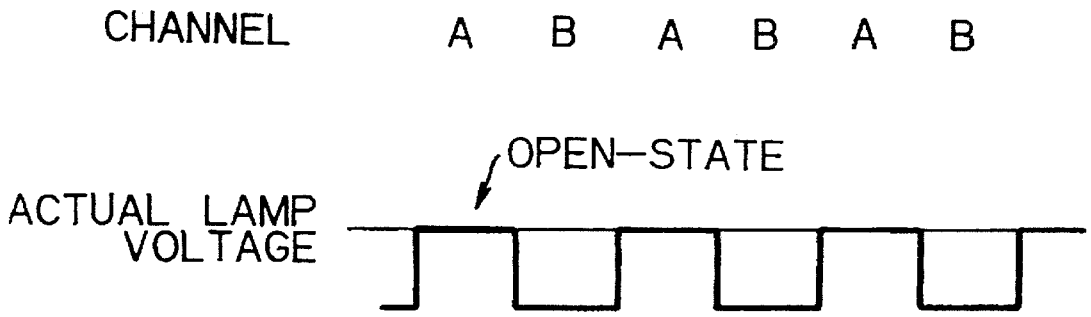
Figure 17B:
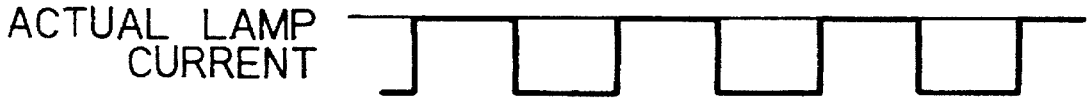
Figure 17C:
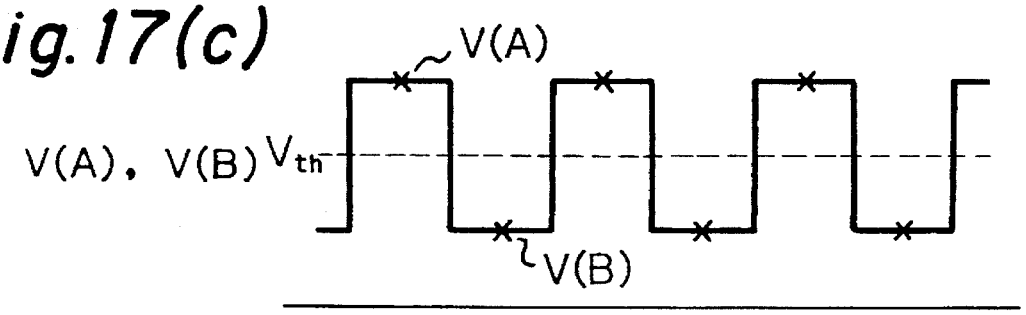
Figure 17D:
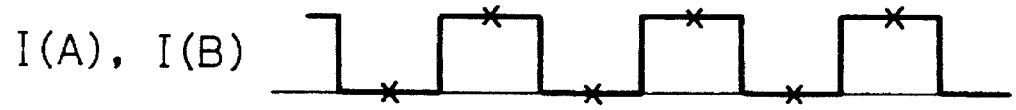
Figure 17E:
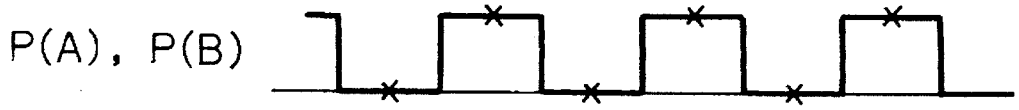
Figure 18A:
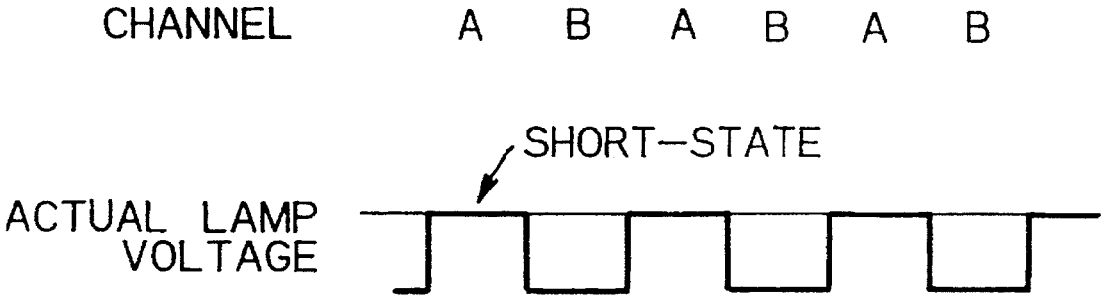
Figure 18B:
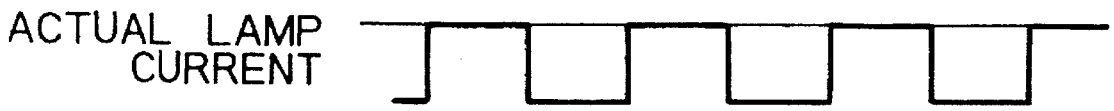
Figure 18C:
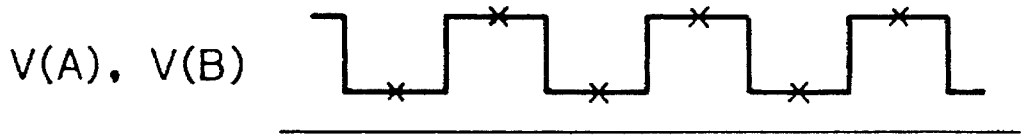
Figure 18D:
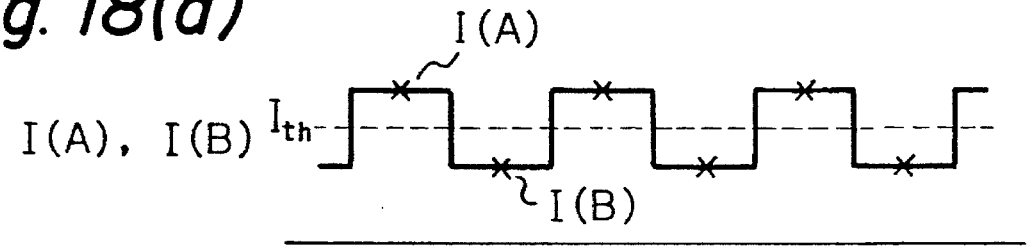
Figure 18E:
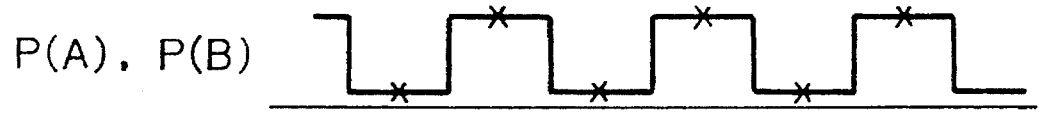

FIG. 15 shows a flow chart schematically representing a part of a control program of the microcomputer in a computer control circuit according to an eighth embodiment. The control program in this embodiment can check troubles of the inverter circuit 13 and of the HID lamp 15. This embodiment can be adapted to only a lighting apparatus with an inverter circuit.

In this eighth embodiment, the circuit constitution of the discharge lamp lighting apparatus is the same as that of the first embodiment. Steps S1500 to S1507 shown in FIG. 15 should be added to the control program shown in FIG. 12 instead of the step S1209. Therefore, operations at these additional steps and at steps related to these additional steps will be mainly described hereinafter.

The inverter circuit 13 will start its alternating operation in synchronous with inverter control signals fed from the computer control circuit 19 via the drive circuit 14. Thus, the switching elements 21*a* and 21*d* (A-channel) and the switching elements 21*b* and 21*c* (B-channel) shown in FIG. 2 alternately turn on and off.

In the instant of turning on the A-channel switching elements 21*a* and 21*d*, the control circuit 19 takes in a current signal which represents the lamp current at that instant via the amplifier 20 and a voltage signal which represents the lamp voltage at that instant (step S1500). These detected current signal and voltage signal are then converted into a detected digital current signal I(A) and a detected digital voltage signal V(A), respectively, by the A/D converters in the control circuit 19. Then, at the step S1501, the microcomputer calculates lamp power P(A) by $P(A)=V(A)\times I(A)$.

Similar to this, in the instant of turning on the B-channel switching elements 21*b* and 21*c*, the control circuit 19 takes in a current signal which represents the lamp current at that instant and a voltage signal which represents the lamp voltage at that instant (step S1502). These detected current signal and voltage signal are then converted into a detected digital current signal I(B) and a detected digital voltage signal V(B), respectively, by the A/D converters. Then, at the step S1503, the microcomputer calculates lamp power P(B) by $P(B)=V(B)\times I(B)$.

At the next step S1504, the control circuit 19 compares these detected lamp voltage V(A) and V(B) with a threshold voltage $V_{th}$. If $V(A)>V_{th}$ or $V(B)>V_{th}$, it is judged that the inverter circuit 13 malfunctions as one of the switching elements of that channel A or B is fixed in off-state (open-state). Then, the computer control circuit 19 outputs a control command to the drive/control circuit 12 so as to stop the power supply from the DC/DC converter circuit 11, resulting the lighting control process to be suspended. As shown in FIG. 16, in normal condition, both the detected lamp voltage V(A) and V(B) of the respective channels are less than the threshold voltage $V_{th}$. However, if the switching element 21*a* of the A-channel malfunctions as it is fixed in off-state (open-state), the A-channel lamp voltage V(A) will exceed the threshold $V_{th}$ as shown in FIG. 17. Thus, the above-mentioned process can detect such the trouble of the inverter circuit 13 and can protect the same from further trouble developed therefrom.

If $V(A)\leqq V_{th}$ and $V(B)\leqq V_{th}$, the program proceeds to the next step S1505 wherein the control circuit 19 compares the detected lamp current I(A) and I(B) with a threshold current $I_{th}$. If $I(A)>I_{th}$ or $I(B)>I_{th}$, it is judged that the inverter circuit 13 malfunctions as one of the switching elements of that channel A or B is fixed in on-state (short-state). Then, the computer control circuit 19 outputs a control command to the drive/control circuit 12 so as to stop the power supply from the DC/DC converter circuit 11, resulting the lighting control process to be suspended. As shown in FIG. 16, in normal condition, both the detected lamp current I(A) and I(B) of the respective channels are less than the threshold current $I_{th}$. However, if the switching element 21*a* of the A-channel malfunctions as it is fixed in on-state (short-state), the A-channel lamp current I(A) will exceed the threshold $I_{th}$ as shown in FIG. 18. Thus, the above-mentioned process can detect such the trouble of the inverter circuit 13 and can protect the same from further trouble developed therefrom.

If $I(A)\leqq I_{th}$ and $I(B)\leqq I_{th}$, the program proceeds to the step S1506 wherein the microcomputer judges whether the detected lamp current I(A) or I(B) of each channel is less than a lower threshold current $I_{under}$ or not. This step S1506 has substantially the same function as the step S1209 in FIG. 12, wherein it is checked whether the HID lamp goes out or not. If $I(A)<I_{under}$ or $I(B)<I_{under}$, it is judged that the lamp goes out, that the lighting switch is turned off, or that a trouble may occur, and the program will proceed to the step S1204 in FIG. 12.

If $I(A)\geqq I_{under}$ and $I(B)\geqq I_{under}$, the program proceeds to the step S1507 wherein the microcomputer judges whether the calculated lamp power P(A) or P(B) of each channel exceeds an upper threshold power $P_{over}$ or not. If $P(A)>P_{over}$ or $P(B)>P_{over}$, it is judged as over power condition and thus the computer control circuit 19 outputs a control command to the drive/control circuit 12 so as to stop the power supply from the DC/DC converter circuit 11, resulting the lighting control process to be suspended. Therefore, the disadvantages concerning the lamp life and damage against the lamp can be effectively prevented.

If $P(A)\leqq P_{over}$ and $P(B)\leqq P_{over}$, the program proceeds to the step S1206 of FIG. 12.

The judgment processes at the steps S1504 to S1507 of this embodiment may be executed by using average values of several lamp voltages V(A) and V(B), lamp current I(A) and I(B), and lamp power P(A) and P(B), respectively.

According to this eighth embodiment of the present invention, the computer control circuit 19 takes in the lamp voltage and the lamp current in synchronous with the alternating operation of the inverter circuit 13 and judges the difference of wave forms of these read lamp voltage and lamp current. Thus, detail diagnosis of the lamp state and the lighting apparatus such as troubles of inverter circuit elements which could not be checked according to the conventional system can be easily carried out. As a result, reliability of trouble-diagnosis function will be extremely improved.

It should be noted that the above-mentioned detail judgment of the wave forms can be realized only by using a microcomputer. Namely, the lighting process control using a microcomputer permits detail process control of the HID lamp even if the lighting control apparatus has very simple constitution. This causes the HID lamp lighting apparatus to downsize and to manufacture with a lower cost. Another advantages of this embodiment are the same as these of the sixth embodiment of FIG. 12.

Ninth Embodiment

Figure 19:
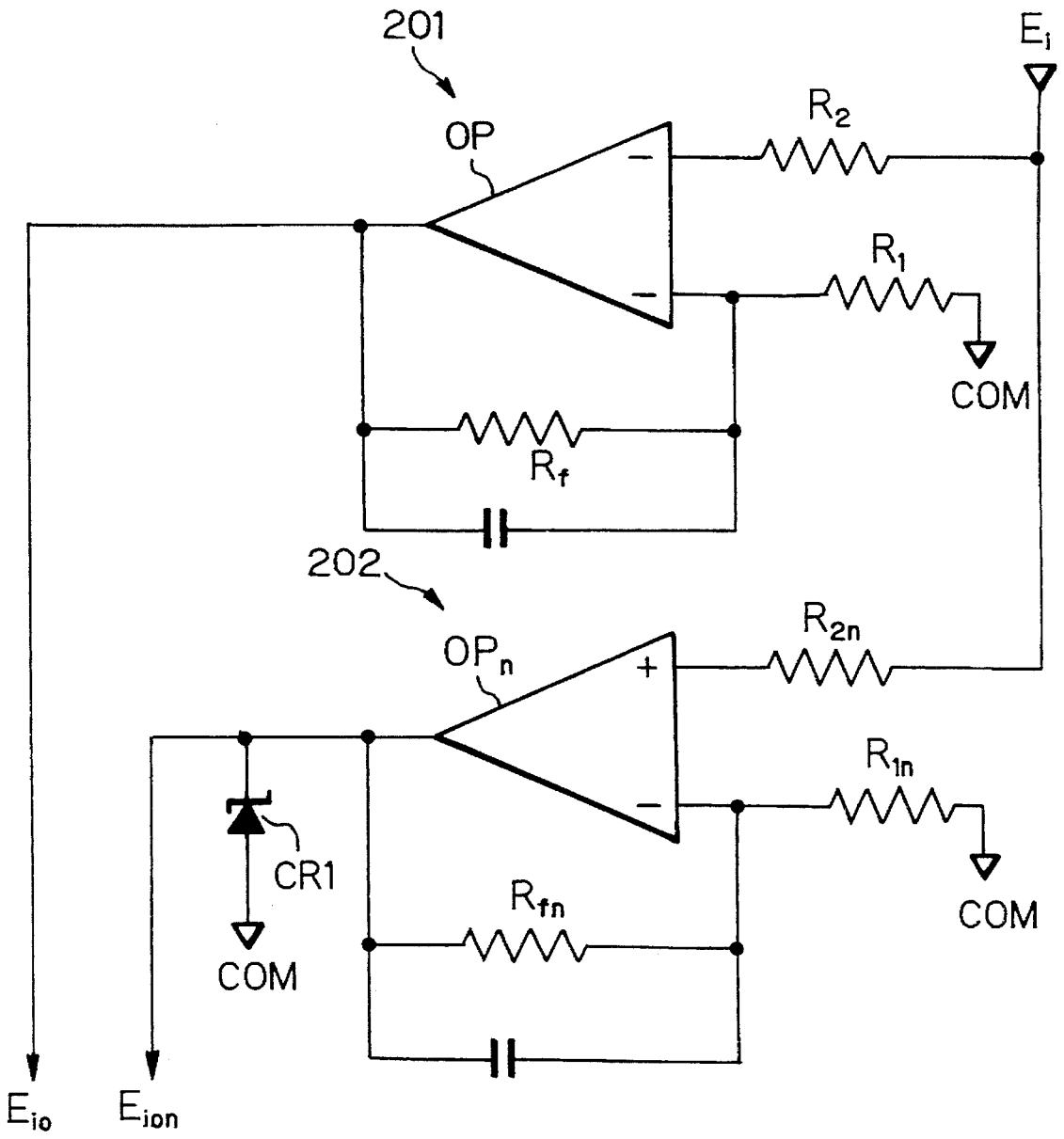
FIG. 19 shows a circuit diagram of an amplifier circuit according to a ninth embodiment of the present invention.

FIG. 19 shows a circuit diagram of an amplifier circuit according to a ninth embodiment of the present invention.

In this ninth embodiment, the circuit constitution of the discharge lamp lighting apparatus is substantially the same as that of the first embodiment except for that of the amplifier circuit 20. As shown in FIG. 19, the amplifier circuit 20 is provided with a non-inverting amplifier 201 having a low amplification factor G, which is mainly constituted by an operational amplifier OP, a non-inverting amplifier 202 having a high amplification factor $G_n$, which is mainly constituted by an operational amplifier $OP_n$, and a Zener diode CR1 for voltage-clamping connected to the output of the non-inverted amplifier 202. As is well known, the amplification factor G of the non-inverting amplifier 201 is given by $G=R_f/R_1$ where $R_f$ and $R_1$ are resistances of a feedback resistor and an input resistor of the amplifier 201, respectively, and also the amplification factor $G_n$ of the non-inverting amplifier 202 is given by $G_n=R_{fn}/R_{1n}$ where $R_{fn}$ and $R_{1n}$ are resistances of a feedback resistor and an input resistor of the amplifier 202, respectively. The relationship between the amplification factors G and $G_n$ is as $G_n=G\times N$ where N is a constant determined depending upon characteristics of the HID lamp. The Zener diode CR1 clamps output voltage $E_{ion}$ of the amplifier 202 having the high amplification factor so that excess voltage will not applied to the A/D converter in the computer control circuit 19.

Figure 20:
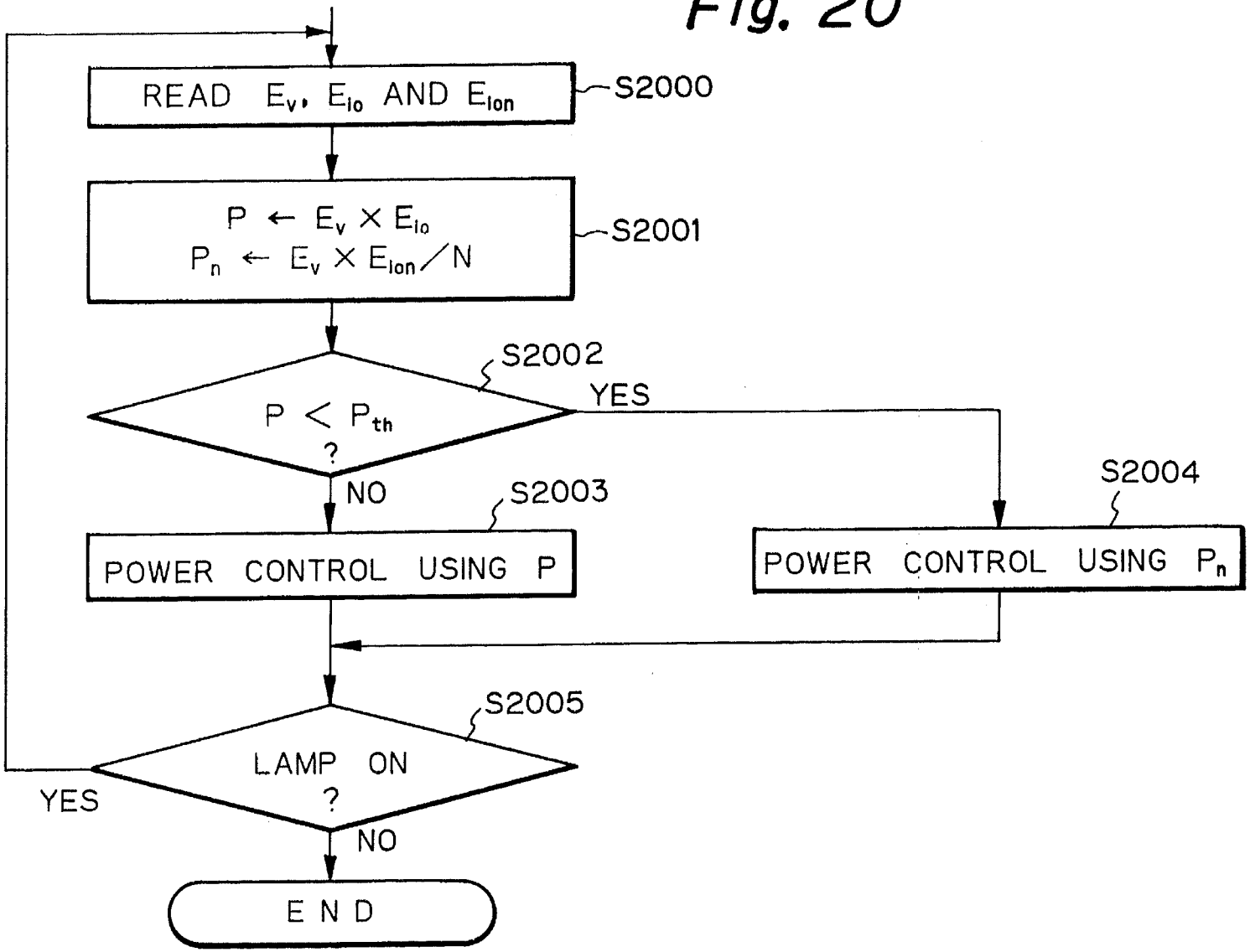
FIG. 20 shows a flow chart schematically representing a part of a control program of a microcomputer according to the ninth embodiment.

FIG. 20 shows a flow chart schematically representing a part of a control program of the microcomputer in the computer control circuit 19 according to this ninth embodiment. The control program in this embodiment can selectively use one of two signals $E_{io}$ and $E_{ion}$ which indicate the lamp current, for calculating actual lamp power. The lamp current signal $E_{io}$ is inputted from the amplifier 201 having the lower amplification factor G, and the lamp current signal $E_{ion}$ is inputted from the amplifier 202 having the higher amplification factor $G_n$.

The control program of steps S2000 to S2005 shown in FIG. 20 should be added to the control program shown in FIG. 4 instead of the steps S404 to S410. Therefore, operations at these additional steps and at steps related to these additional steps will be mainly described hereinafter.

At the step S2000 which will be executed next to the step S403, the computer control circuit 19 takes in a lamp voltage signal $E_v$, the lamp current signal $E_{io}$ from the amplifier 201 having the lower amplification factor G, and the lamp current signal $E_{ion}$ from the amplifier 202 having the higher amplification factor $G_n$. Then, at the step S2001, the microcomputer calculates the actual lamp powers P and $P_n$ by $P=E_v\times E_{io}$ and $P_n=E_v\times E_{ion}/N$, respectively. Then, at the step S2002, it is judged whether the calculated lamp power P is less than a threshold power $P_{th}$ which is determined to a value near the nominal lamp power. In other words, at the step S2002, whether it is in its starting state of the lamp or not is judged.

If it is not $P<P_{th}$, namely if it is still in the starting state, the program proceeds to the step S2003 wherein the lamp power is controlled using the calculated lamp power P so that the lamp power P approaches to the nominal lamp power as similar as the process at the steps S406 to S409 in the control program of the first embodiment. Then, at the step S2005, the microcomputer 19 judges whether the lamp is lighted or not by comparing the lamp current $E_{io}$ with a predetermined threshold value or by comparing the lamp voltage $E_v$ with a predetermined threshold value. If it is judged that the lamp is lighted out, the program ends. If it is judged that the lamp is lighted up, the program returns to the step S2000. Thus, the power control process using the lamp current signal $E_{io}$ from the amplifier 201 having the lower amplification factor G is executed during the starting state of the lamp.

If $P<P_{th}$, namely if the lamp is already operating in its stable state, the program branches to the step S2004 wherein the lamp power is controlled by using the calculated lamp power $P_n$ so that the lamp power $P_n$ approaches to the nominal lamp power as similar as the processes at the steps S406 to S409 in the control program of the first embodiment.

In case it is controlled that the calculated lamp power should be switched from P to $P_n$, it is desired to check that $P_n$ is substantially equal to P in order to prevent the actual lamp power from being abruptly changed.

Then, at the step S2005, it is judged whether the lamp is lighted or not as aforementioned. Thus, the power control process using the lamp current signal $E_{ion}$ from the amplifier 202 having the higher amplification factor $G_n$ is repeatedly executed during the stable state of the lamp.

Figure 21:
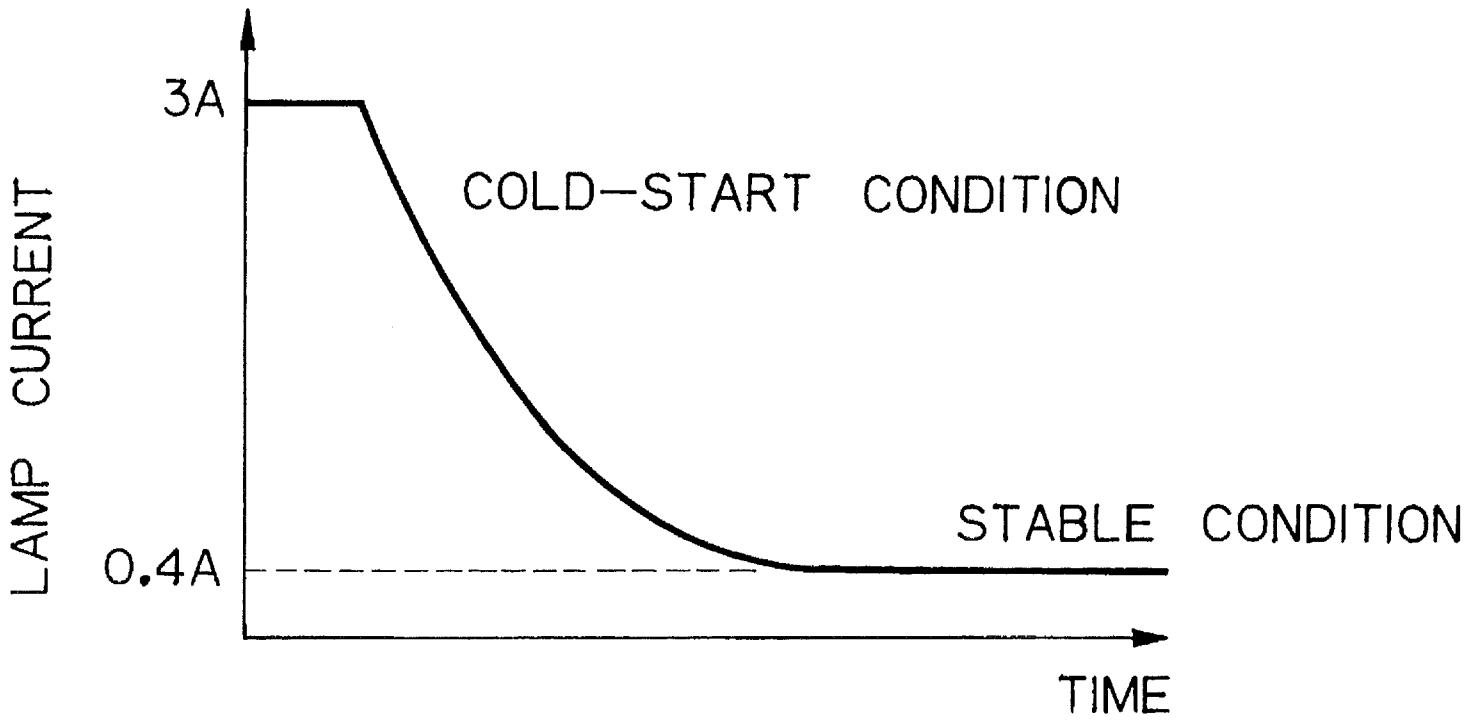
FIG. 21 shows lamp current characteristics of the HID lamp with respect to time according to a conventional lighting apparatus.

Since HID lamps used for light sources of the automobile head light are required to rapidly rise its luminous flux even when it is cold-started, several times of the nominal lamp power will be in general applied to the lamp at starting state. As shown in FIG. 21, for a certain HID lamp, the lamp current is required to be for example about 3 A at cold-start condition whereas about 0.4 A at stable condition. Thus, the lighting control apparatus has to control the lamp current over a very wide range. In order to cover the whole range of the lamp current by a single amplifier having a fixed amplification factor, this amplification factor has to be selected to a relatively small value. This is because that the varying range of the lamp current signal applied to A/D converter of the computer control circuit 19 is limited by a resolution of the A/D converter, for example, 1/256 in case of 8 bit. As a result, at stable condition wherein the actual lamp current is small, the lamp current cannot be precisely detected, and thus the lamp power cannot be precisely controlled.

Figure 22:
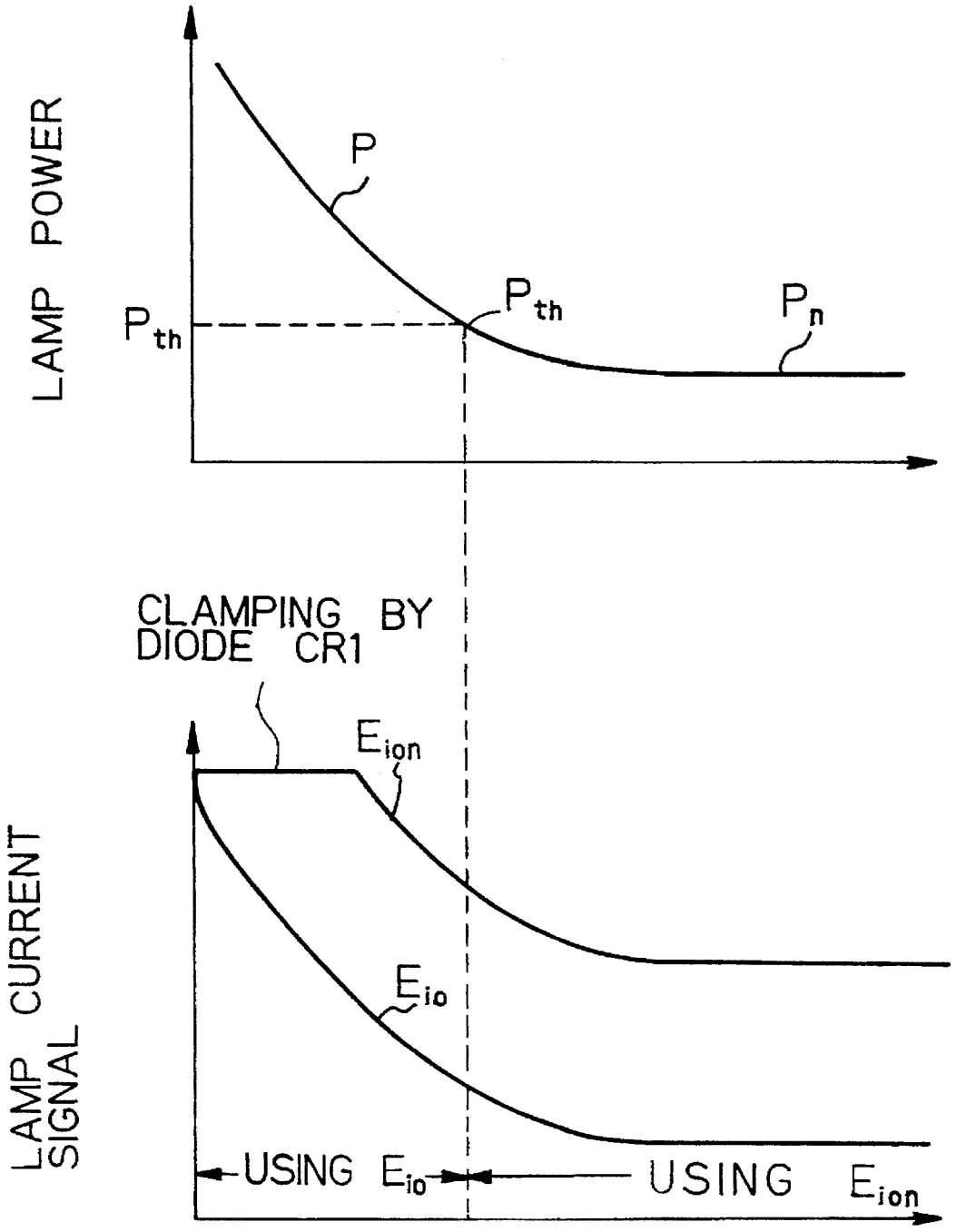
FIG. 22 shows lamp power and lamp current signal characteristics of the HID lamp with respect to time according to the lighting apparatus of the ninth embodiment.

However, according to this ninth embodiment of the present invention, at starting condition wherein the actual lamp current will be large, the lamp current signal $E_{io}$ amplified by the amplifier having the lower amplification factor G is used for controlling the lamp power, as shown in FIG. 22. Thus, a very wide range of the lamp current, in other words, a very large lamp current at cold-start condition can be detected, although it will result poor resolution. Furthermore, at stable condition wherein the actual lamp current is relatively small, the other lamp current signal $E_{in}$ amplified by the amplifier having the higher amplification factor $G_n$ is used. Thus, high resolution can be expected although the detection range of the lamp current will be narrow. As a result, high accurate control of the lamp power at its stable condition can be executed, and also quick response against changes in the power supply voltage, in the lamp condition and in the lamp temperature can be expected causing flicker of the lamp to prevent from occurring.

Another advantages of this embodiment are the same as these of the first embodiment.

In this embodiment, whether the lamp is in the starting condition or the stable condition is judged by comparing the calculated lamp power P with the threshold $P_{th}$. However, this judgment can be carried out by comparing the lamp current, the lamp voltage or time period elapsed after starting with its threshold.

Tenth Embodiment

Figure 23:
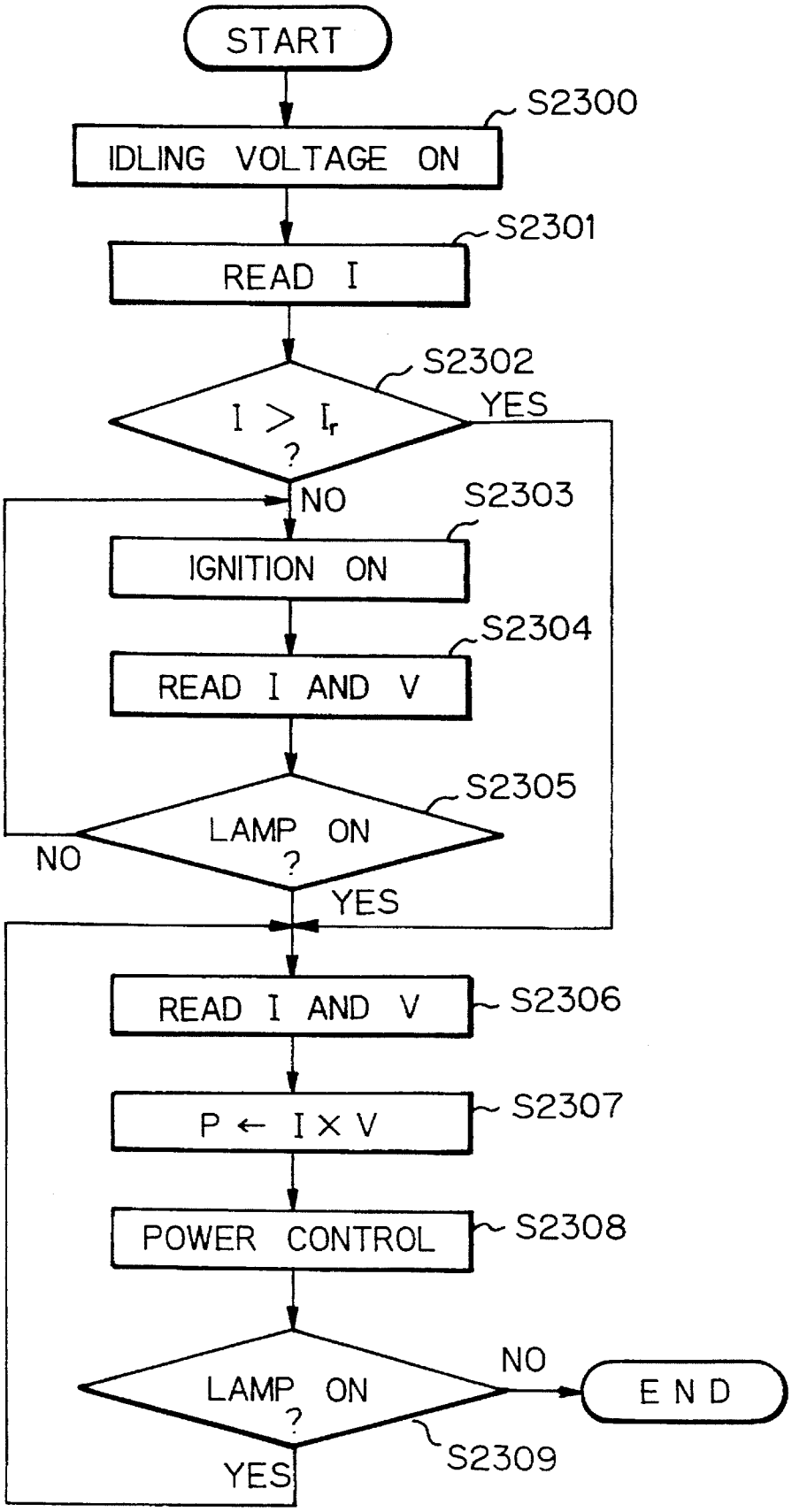
FIG. 23 shows a flow chart schematically representing a part of a control program of a microcomputer in a computer control circuit according to a tenth embodiment.

FIG. 23 shows a flow chart schematically representing a part of a control program of the microcomputer in a computer control circuit according to a tenth embodiment. The control program of this embodiment can check whether a load connected to the output of the inverter circuit 13 is an HID lamp or a dummy resistor used for measuring or adjusting output power of the lighting apparatus.

In this tenth embodiment, the circuit constitution of the discharge lamp lighting apparatus is the same as that of the first embodiment. Also, the operations at steps S2300 and S2303 to S2309 are quite the same as that at the steps S400 to S410 in the first embodiment, respectively. Namely, in this embodiment, process at steps S2301 and S2302 are newly added to the process in the first embodiment. Therefore, operations only at these additional steps will be described hereinafter.

At the step S2301 which is just after the step S2300 where idling voltage is applied to the lamp and before applying ignition pulses, the lamp current I is taken in the computer control circuit 19. Then, at the step S2302, the control circuit 19 checks whether a certain current is outputted from the inverter circuit 13 by comparing the read lamp current I with a threshold value $I_r$.

If the connected load is an HID lamp, since the HID lamp will not be lighted before applying ignition pulses and thus its impedance will be extremely high, only minute current called as Townsent current flows. Therefore, in this case, it will result as $I \leqq I_r$, and thus the program proceeds to the next step S2303 wherein the ignition pulses will be applied to the lamp.

If the connected load is a dummy resistor having a resistance substantially the same as that of the HID lamp at its stable condition, the current flowing the load (dummy resistor) just after idling voltage is applied thereto will be large as $I > I_r$. Therefore, the program jumps to the step S2306. Then, the step S2306 to S2309 which are process of controlling lamp power to a target lamp power (generally corresponding to a nominal lamp power) are carried out without executing the process at the step S2303 for applying ignition pulses to the dummy resistor. Operation at the step S2308 corresponds to that at the steps S406 to S409 in the first embodiment.

Figure 24:
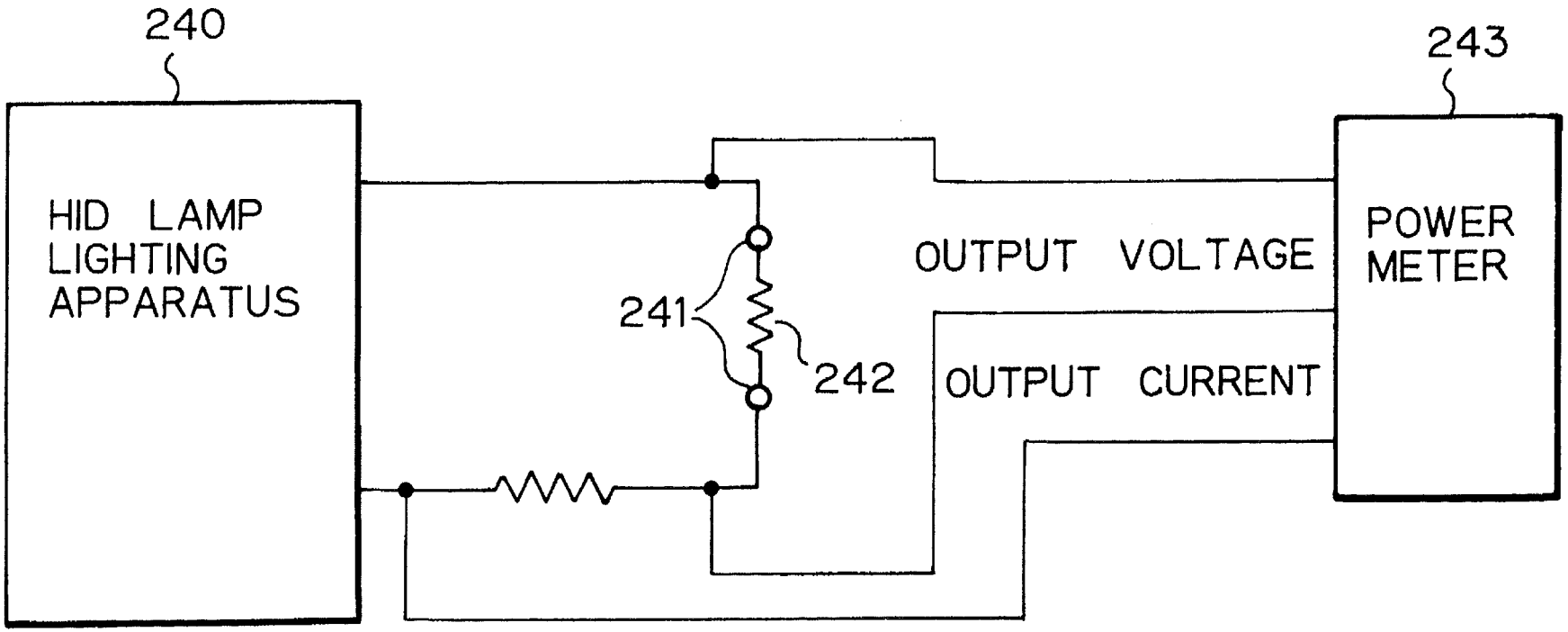
FIG. 24 shows an example of a circuit constitution for measuring the output power during adjustment of the lighting apparatus.

In general, the output power of an HID lamp lighting apparatus should be initially adjusted to the nominal power after manufactured. FIG. 24 shows an example of a circuit constitution for measuring the output power during such the adjustment of the lighting apparatus. As shown in this figure, across the output terminals 241 of the lighting apparatus 240 to be adjusted, a dummy resistor 242 having a resistance substantially the same as that of the HID lamp at its stable condition is connected. A power meter 243 for measuring the output power of the apparatus 240 is connected so as to receive the output current and output voltage from the apparatus. The output power of the apparatus 240 is adjusted by adjusting a trimmer (not shown) in the apparatus so that the output power measured by the power meter 243 coincides to the nominal power.

By using the cheap dummy resistor 242 instead of a HID lamp, it is possible to measure the output power with a high accuracy and a good reproducibility within a short time period. However, since ignition pulses with very high voltage are automatically applied to the dummy resistor according to the conventional lighting apparatus, the operator for the measurement may suffer from dangerous and also the measuring device such as the power meter may be troubled.

However, the lighting apparatus of this tenth embodiment can solve such the disadvantages of the conventional apparatus. Namely, as aforementioned, the computer control circuit automatically executes the stable power control process without applying any ignition pulse to the dummy resistor (or the HID lamp) and also without executing the starting power control process when he judges that the resistor load is connected across the output terminals of the inverter circuit. As a result, the lighting apparatus of this embodiment is extremely safety and a power measuring device can be protected from possible troubles due to the application of the high voltage ignition pulses and the great power which will be several times of the nominal power. Also, since the lighting apparatus automatically detects that the resistor load is connected across the output terminals of the inverter circuit instead of the HID lamp, no manual switch for stopping the application of ignition pulses is necessary. Another advantages of this embodiment are the same as these of the first embodiment.

It should be noted that the above-mentioned detail control of the HID lamp can be realized only by using a microcomputer. Namely, the lighting process control using a microcomputer permits detail process control of the HID lamp even if the lighting control apparatus has very simple constitution. This causes the HID lamp lighting apparatus to downsize and to manufacture with a lower cost.

Eleventh Embodiment

Figure 25:
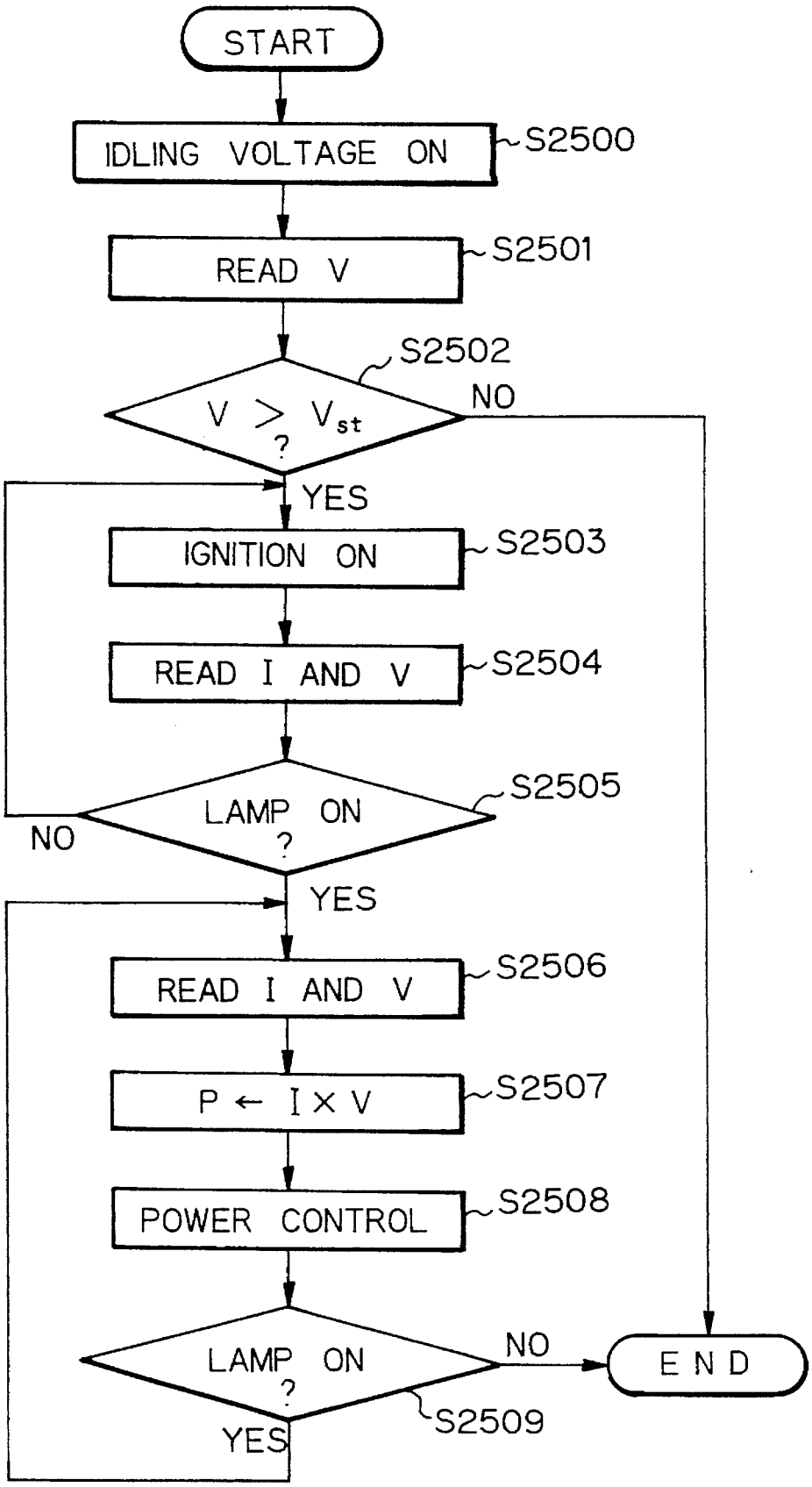
FIG. 25 shows a flow chart schematically representing a part of a control program of a microcomputer in a computer control circuit according to an eleventh embodiment.

FIG. 25 shows a flow chart schematically representing a part of a control program of the microcomputer in a computer control circuit according to an eleventh embodiment. The control program of this embodiment can check whether the lamp voltage just after starting is normal or abnormal.

In this eleventh embodiment, the circuit constitution of the discharge lamp lighting apparatus is the same as that of the first embodiment. Also, the operations at steps S2500 and S2503 to S2509 are quite the same as that at the steps S400 to S410 in the first embodiment, respectively. It is apparent that operation at the step S2508 corresponds to that at the steps S406 to S409 in the first embodiment. Namely, in this embodiment, process at steps S2501 and S2502 are newly added to the process in the first embodiment. Therefore, operations only at these additional steps will be described hereinafter.

At the step S2501 which is just after the step S2500 where idling voltage is applied to the lamp and before applying ignition pulses, the lamp voltage V is read into the computer control circuit 19. Then, at the step S2502, the control circuit 19 checks whether a certain start voltage is applied to the HID lamp by comparing the read lamp voltage V with a threshold value $V_{st}$.

If $V > V_{st}$, it is judged the internal circuits of the lighting apparatus operates in normal and the program proceeds to the next step S2503 wherein the ignition pulses will be applied to the lamp.

If not $V>V_{st}$, the microcomputer judges that there may occur a trouble in the internal circuits of the lighting apparatus and the program ends, resulting the computer control circuit 19 to output a control command to the drive/control circuit 12 so as to stop the power supplying operation from the DC/DC converter circuit 11. Thus, the lighting control process is suspended.

Another operations and advantages of this embodiment are the same as these of the first embodiment.

Twelfth Embodiment

Figure 26:
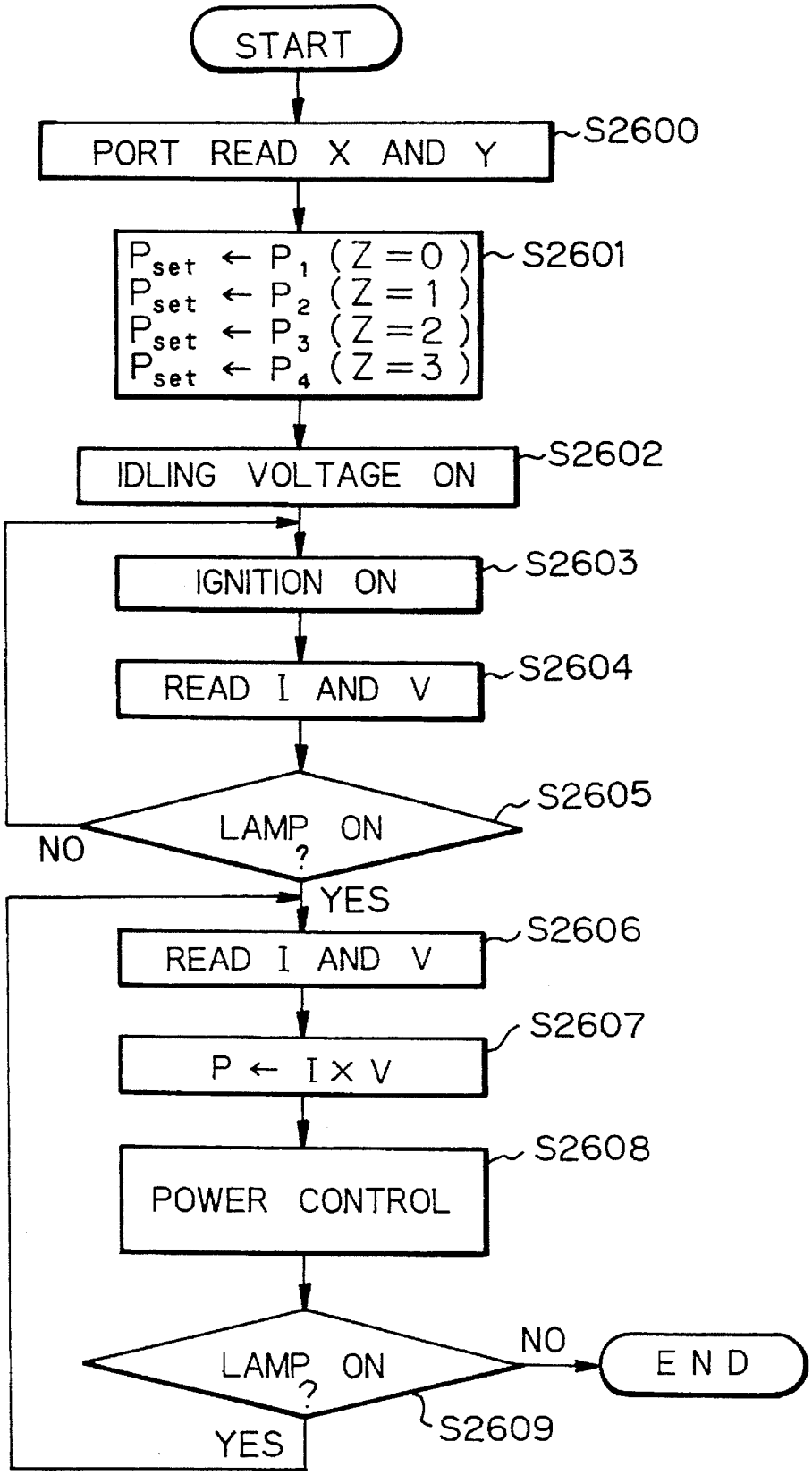
FIG. 26 shows a flow chart schematically representing a part of a control program of a microcomputer in a computer control circuit according to a twelfth embodiment.

FIG. 26 shows a flow chart schematically representing a part of a control program of the microcomputer in a computer control circuit according to a twelfth embodiment.

Figure 27:
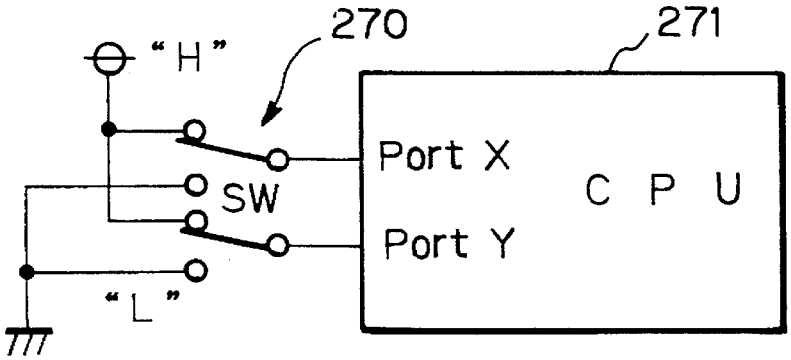
FIG. 27 shows a matrix table for deciding a target lamp power value.

In this twelfth embodiment, the circuit constitution of the discharge lamp lighting apparatus is the same as that of the first embodiment except that the computer control circuit 19 is additionally provided with a set switch 270 connected to ports X and Y of a CPU 271 in its microcomputer, as shown in FIG. 27. Also, the operations at steps S2602 to S2609 are quite the same as that at the steps S400 to S410 in the first embodiment. In this embodiment, process at steps S2600 and S2601 are newly added to the process in the first embodiment, Therefore, operations at these additional steps and at steps related to these additional steps will be mainly described hereinafter.

At the step S2600 which will be executed just after the lighting switch (not shown) is turned on, the microcomputer reads the state of the ports X and Y. To these ports, high or low level signals are preliminarily applied from the set switch 270. At the next step S2601, the microcomputer decides Z from the read two bits signal (X,Y) by using a matrix table shown in FIG. 27, which is preliminarily stored in its memory, and then sets the target lamp power $P_{set}$ to one of different values $P_1$ to $P_4$ depending upon the content of Z. Namely, for example, if X=L and Y=L, Z is decided as Z=1 and $P_{set}$ is set to $P_1$. Thus, at the step S2608 which corresponds to the steps S406 to S409 in the first embodiment, process of controlling lamp power P to this decided target lamp power $P_{set}$ will be executed. The values $P_1$ to $P_4$ may be predetermined to different nominal lamp powers of various HID lamps manufactured by the different makers.

According to this twelfth embodiment of the present invention, the computer control circuit 19 first detects the state of the ports X and Y and selectively decides the target lamp power depending upon the detected state. Thus, the same lighting apparatus can be adapted to various HID lamps having different nominal powers, for example 120 W, 140 W, 150 W and 155 W, only by switching the set switch without adjusting a power control volume or without rewriting the control program. Another advantages of this embodiment are the same as these of the first embodiment.

The number of the ports is not limited to two, but can be selected any number such as one or more than two.

In the above-mentioned embodiment, the target lamp power is selected in accordance with the set switch. However, set values other than the target lamp power, for example lamp current or lamp voltage can be similarly selected depending upon the content of the set switch.

This lighting apparatus can be also utilized as a dimming apparatus by changing the target lamp power applied to the same HID lamp depending upon the content of the set switch.

Thirteenth Embodiment

Figure 28:
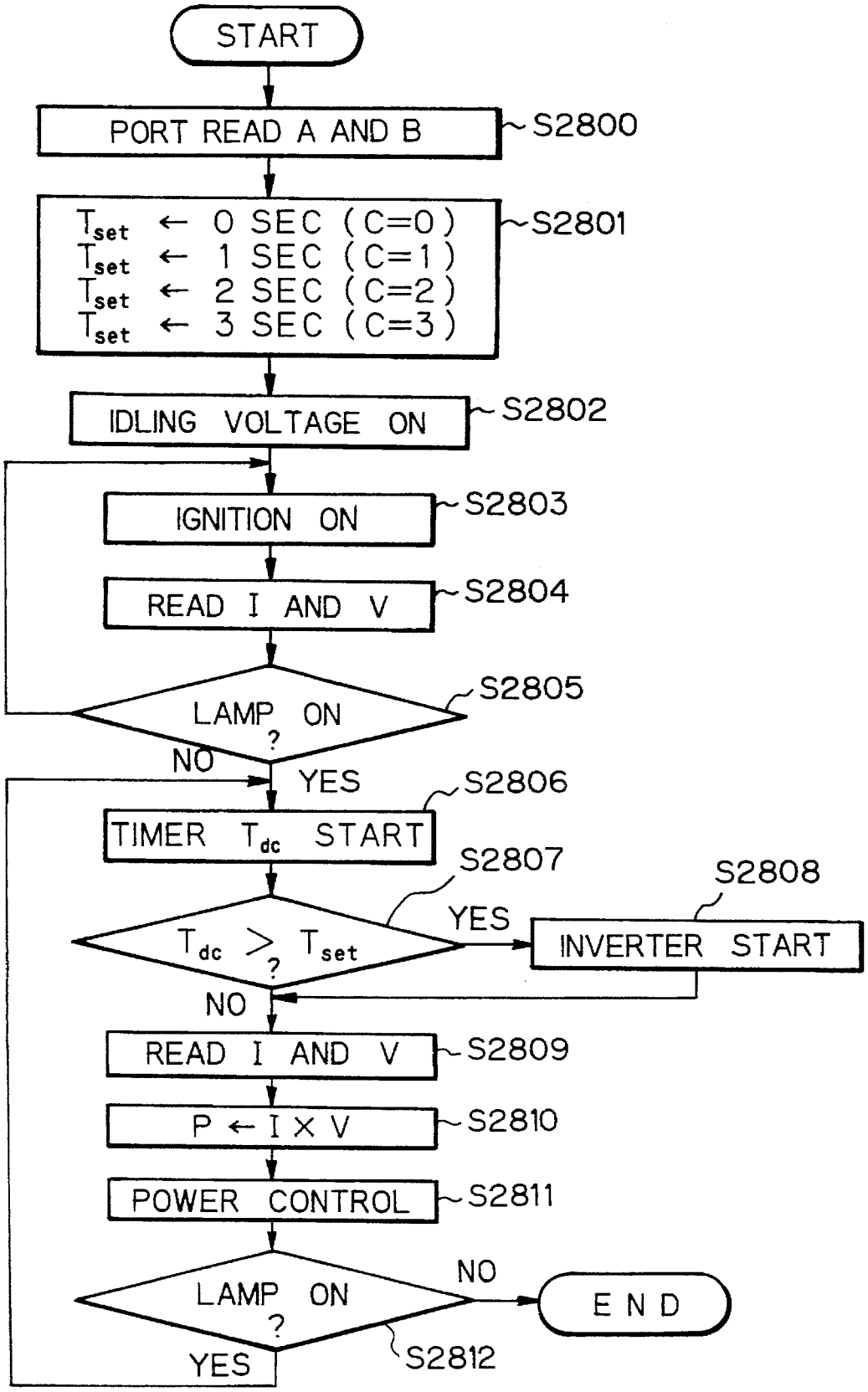
FIG. 28 shows a flow chart schematically representing a part of a control program of a microcomputer in a computer control circuit according to a thirteenth embodiment.

FIG. 28 shows a flow chart schematically representing a part of a control program of the microcomputer in a computer control circuit according to a thirteenth embodiment. This control program can select the DC lighting period shown in FIG. 6 to a desired one.

Figure 29:
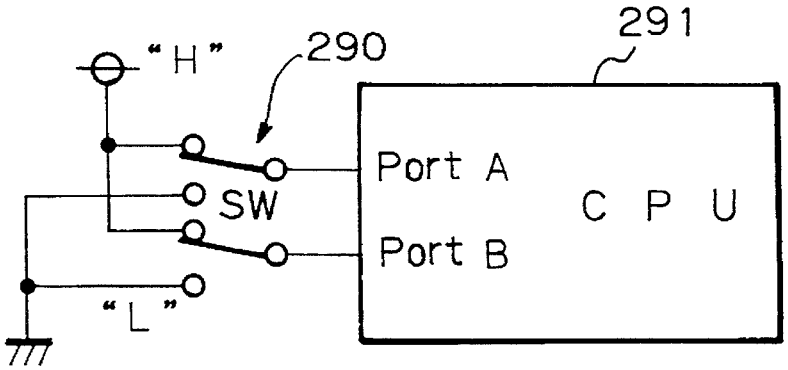
FIG. 29 shows a matrix table for deciding a DC lighting period value.

In this thirteenth embodiment, the circuit constitution of the discharge lamp lighting apparatus is the same as that of the first embodiment except that the computer control circuit 19 is additionally provided with a set switch 290 connected to ports A and B of a CPU 291 in its microcomputer, as shown in FIG. 29. Also, the operations at steps S2802 to S2805 and steps S2809 to S2812 are substantially the same as that at the steps S400 to S403 and steps S404 to S410 in the first embodiment, respectively. In this embodiment, process at steps S2800 and S2801 and steps S2806 to S2808 are newly added to the process in the first embodiment. Therefore, operations at these additional steps and at steps related to these additional steps will be mainly described hereinafter.

At the step S2800 which will be executed just after the lighting switch (not shown) is turned on, the microcomputer reads the state of the ports A and B. To these ports, high or low level signals are preliminarily applied from the set switch 290. At the next step S2801, the microcomputer decides C from the read two bits signal (A,B) by using a matrix table shown in FIG. 29, which is preliminarily stored in its memory, and then sets the DC lighting period $T_{set}$ to one of different values 0 second to 3 second depending upon the content of C. Namely, for example, if A=L and B=L, C is decided as C=0 and the DC lighting period $T_{set}$ is set to 0 second, resulting that there is no DC lighting period and thus the lamp is driven by AC power from starting.

At the step S2806 which will be executed just after the step S2805 wherein it is confirmed that the HID lamp is lighted, a timer in the microcomputer starts counting of actual DC lighting period $T_{dc}$. Then, at the next step S2807, the microcomputer judges whether this actual DC lighting period exceeds the set period $T_{set}$ or not. Only when $T_{dc}>T_{set}$, the program proceeds to the step S2808 wherein the computer outputs a command signal to the drive circuit 14 so that the inverter circuit 13 starts its inverting operation and outputs AC power to the HID lamp 15.

According to this thirteenth embodiment of the present invention, the computer control circuit 19 first detects the state of the ports A and B and selectively decides the DC lighting period depending upon the detected state. Thus, the DC lighting period can be easily selected without rewriting the control program. Another advantages of this embodiment are the same as these of the first embodiment.

The number of the ports is not limited to two, but can be selected any number such as one or more than two.

It will be apparent that the lighting apparatus according to the present invention can be constituted by combining any of the lighting apparatus of the aforementioned embodiments.

Many widely different embodiments of the present invention may be constructed without departing from the spirit and scope of the present invention. It should be understood that the present invention is not limited to the specific embodiments described in the specification, except as defined in the appended claims.

What is claimed is:

1. A lighting apparatus for a discharge lamp, comprising:

a power adjustment means for adjusting electrical power to be supplied to the discharge lamp;

an ignition pulse production means for producing at least one ignition pulse to be applied to the discharge lamp;

a detection means for detecting a lighting condition of the discharge lamp; and a computer control means electrically connected with said power adjustment means, said ignition pulse production means and said detection means, said computer control means controlling said power adjustment means and said ignition pulse production means so that at first said power adjustment means supplies an idling voltage to the discharge lamp, then said ignition pulse production means lights up the discharge lamp by applying at least one ignition pulse to the discharge lamp, and thereafter said power adjustment means controls lamp power of the discharge lamp to a target lamp power, said detection means including a current detection means for detecting a current corresponding to a lamp current of the discharge lamp to output a first signal which represents the detected current and a voltage detection means for detecting a voltage corresponding to a lamp voltage of the discharge lamp to output a second signal which represents the detected voltage, said computer control means calculating a lamp power of the discharge lamp from said first and second signals to produce a control signal for controlling said power adjustment means in accordance with the calculated lamp power, and stopping power supply to the discharge lamp from said power adjustment means if it is judged that said calculated lamp power exceeds a predetermined allowable power.

2. The apparatus as claimed in claim 1, wherein said computer control means stops power supply to the discharge lamp from said power adjustment means if the second signal just after the idling voltage is applied to the discharge lamp indicates an abnormal lamp voltage.

3. A lighting apparatus for a discharge lamp, comprising:

a power adjustment means for adjusting electrical power to be supplied to the discharge lamp;

an ignition pulse production means for producing at least one ignition pulse to be applied to the discharge lamp;

a detection means for detecting a lighting condition of the discharge lamp; and a computer control means electrically connected with said power adjustment means, said ignition pulse production means and said detection means, said computer control means controlling said power adjustment means and said ignition pulse production means so that at first said power adjustment means supplies an idling voltage to the discharge lamp, then said ignition pulse production means lights up the discharge lamp by applying at least one ignition pulse to the discharge lamp, and thereafter said power adjustment means controls lamp power of the discharge lamp to a target lamp power, said detection means including a current detection means for detecting a current corresponding to a lamp current of the discharge lamp to output a first signal which represents the detected current and a voltage detection means for detecting a voltage corresponding to a lamp voltage of the discharge lamp to output a second signal which represents the detected voltage, said power adjustment means including a DC/DC converter circuit for converting a source voltage into a DC voltage so as to adjust electrical power to be supplied to the discharge lamp, and an inverter circuit for inverting the DC voltage from said DC/DC converter circuit into an AC voltage, said computer control means calculating a lamp power of the discharge lamp from said first and second signals to produce a control signal for controlling said DC/DC converter circuit in accordance with the calculated lamp power, and stopping power supply to the discharge lamp from said DC/DC converter circuit if it is judged that a first or second signal which is sampled in synchronous with the alternating operation of said inverter circuit exceeds a predetermined value.

4. A lighting apparatus for a discharge lamp, comprising:

a power adjustment means for adjusting electrical power to be supplied to the discharge lamp;

an ignition pulse production means for producing at least one ignition pulse to be applied to the discharge lamp;

a computer control means electrically connected with said power adjustment means and said ignition pulse production means, said computer control means controlling said power adjustment means and said ignition pulse production means so that at first said power adjustment means supplies an idling voltage to the discharge lamp, then said ignition pulse production means lights up the discharge lamp by applying at least one ignition pulse to the discharge lamp, and thereafter said power adjustment means controls lamp power of the discharge lamp to a target lamp power; and a current detection means for detecting a current corresponding to a lamp current of the discharge lamp to output a signal which represents the detected current, said computer control means checking the signal from said current detection means to judge whether the discharge lamp is lighted or not, at each time when one ignition pulse is applied to the discharge lamp, and stopping production of the ignition pulse from said ignition pulse production means if the lamp is lighted.

5. The apparatus as claimed In claim 4, wherein said computer control means stops production of the ignition pulse from said ignition pulse production means when the discharge lamp is not lighted although a predetermined time period is elapsed after the first ignition pulse was applied to the lamp.

6. The apparatus as claimed in claim 4, wherein said computer control means stops production of the ignition pulse from said ignition pulse production means when the discharge lamp is not lighted although a predetermined number of the ignition pulses are sequentially applied to the lamp.

7. A lighting apparatus for a discharge lamp, comprising:

a power adjustment means for adjusting electrical power to be supplied to the discharge lamp;

an ignition pulse production means for producing at least one ignition pulse to be applied to the discharge lamp;

a computer control means electrically connected with said power adjustment means and said ignition pulse production means, said computer control means controlling said power adjustment means and said ignition pulse production means so that at first said power adjustment means supplies an idling voltage to the discharge lamp, then said ignition pulse production means lights up the discharge lamp by applying at least one ignition pulse to the discharge lamp, and thereafter said power adjustment means controls lamp power of the discharge lamp to a target lamp power; and a voltage detection means for detecting a voltage corresponding to a lamp voltage of the discharge lamp to output a signal which represents the detected voltage, said computer control means determining a limiting value of a lamp current of the discharge lamp depending upon a value of the signal just after the lamp is lighted, and controlling said power adjustment means so that the lamp current supplied to the lamp from the power adjustment means is equal to or less than said determined limiting value.

8. A lighting apparatus for a discharge lamp, comprising:

a power adjustment means for adjusting electrical power to be supplied to the discharge lamp;

an ignition pulse production means for producing at least one ignition pulse to be applied to the discharge lamp;

a computer control means electrically connected with said power adjustment means and said ignition pulse production means, said computer control means controlling said power adjustment means and said ignition pulse production means so that at first said power adjustment means supplies an idling voltage to the discharge lamp, then said ignition pulse production means lights up the discharge lamp by applying at least one ignition pulse to the discharge lamp, and thereafter said power adjustment means controls lamp power of the discharge lamp to a target lamp power;

a current detection means for detecting a current corresponding to a lamp current of the discharge lamp to output a first signal which represents the detected current;

a voltage detection means for detecting a voltage corresponding to a lamp voltage of the discharge lamp to output a second signal which represents the detected voltage;

a memory means for storing a last lamp power just before the discharge lamp was lighted out at last time; and a time detection means for detecting a time period of lights-out of the discharge lamp, said computer control means calculating a lamp power of the discharge lamp from said first and second signals to produce a control signal for controlling said power adjustment means, and calculating an initial lamp power at starting by using an approximate equation with respect to variables of the last lamp power from said memory and the time period of lights-out from said time detecting means, said power adjustment means controlling the lamp power to be supplied to the discharge lamp at starting to approach the calculated initial lamp power.

9. The apparatus as claimed in claim 8, wherein said computer control means calculates the initial lamp power at starting $P_{on}$ by using the approximate equation of, $$P_{on}=(P_m-P_{off})\times(1-e^{-T_{off}/\beta})+P_{off}$$

where $P_m$ is the maximum lamp power at starting, $P_{off}$ is the last lamp power, $T_{off}$ is the time period of lights-out, and $\beta$ is a constant.

10. The apparatus as claimed in claim 9, wherein said computer control means calculates a lamp power after starting $P_{exp}$ by using the approximate equation of, $$P_{exp}=(P_{on}-P_{set})\times e^{-T_{on}/\alpha}+P_{set}$$

where $P_{set}$ is a nominal lamp power, $T_{on}$ is a time period of lighting, and $\alpha$ is a constant, and wherein said power adjustment means controls the/amp power supplied to the discharge lamp after starting to the calculated lamp power $P_{exp}$.

11. The apparatus as claimed in claim 8, wherein said computer control means regulates the calculated initial lamp power to a value equal to or less than the maximum allowable lamp power $P_{limt}$ of said discharge lamp.

12. A lighting apparatus for a discharge lamp, comprising a power adjustment means for adjusting electrical power to be supplied to the discharge lamp;

an ignition pulse production means for producing at least one ignition pulse to be applied to the discharge lamp;

a computer control means electrically connected with said power adjustment means and said ignition pulse production means, said computer control means controlling said power adjustment means and said ignition pulse production means so that at first said power adjustment means supplies an idling voltage to the discharge lamp, then said ignition pulse production means lights up the discharge lamp by applying at least one ignition pulse to the discharge lamp, and thereafter said power adjustment means controls lamp power of the discharge lamp to a target lamp power;

a current detection means for detecting a current corresponding to a lamp current of the discharge lamp to output a first signal which represents the detected current; and an amplifier means for amplifying the first signal from said current detection means with a plurality of amplification factors which are different from each other to output respective second signals, said computer control mans controlling the lamp power to be supplied to the discharge lamp by using one of the second signals, which is amplified by said amplifier means with a lower one of the amplification factors during starting condition, and by using another one of the second signals which is amplified by said amplifier means with a higher one of the amplification factors during stable condition.

13. A lighting apparatus for a discharge lamp, comprising:

a power adjustment means for adjusting electrical power to be supplied to the discharge lamp;

an ignition pulse production means for producing at least one ignition pulse to be applied to the discharge lamp;

computer control means electrically connected with said power adjustment means and said ignition pulse production means, said computer control means controlling said power adjustment means and said ignition pulse production means so that at first said power adjustment means supplies an idling voltage to the discharge lamp, then said ignition pulse production means lights up the discharge lamp by applying at least one ignition pulse to the discharge lamp, and thereafter said power adjustment means controls lamp power of the discharge lamp to a target lamp power: and a current detection means for detecting a current corresponding to a lamp current of the discharge lamp to output a signal which represents the detected current, said computer control means stopping production of the ignition pulse from said ignition pulse production means if the signal from said current detection means after the idling voltage is applied to the discharge lamp but before any ignition pulse is applied to the lamp exceeds a predetermined value.

14. A lighting apparatus for a discharge lamp, comprising:

a power adjustment means for adjusting electrical power to be supplied to the discharge lamp;

an ignition pulse production means for producing at least one ignition pulse to be applied to the discharge lamp;

a computer control means electrically connected with said power adjustment means and said ignition pulse production means, said computer control means controlling said power adjustment means and said ignition pulse production means so that at first said power adjustment means supplies an idling voltage to the discharge lamp, then said ignition pulse production means lights up the discharge lamp by applying at least one ignition pulse to the discharge lamp, and thereafter said power adjustment means controls lamp power of the discharge lamp to a target lamp power; and a set switch capable of supplying a variable signal to said computer control means, said computer control means preliminarily storing a plurality of different target lamp powers, and selecting one of the stored target lamp powers depending upon the variable signal from said set switch.

15. A lighting apparatus for a discharge lamp, comprising:

a power adjustment means for adjusting electrical power to be supplied to the discharge lamp;

an ignition pulse production means for producing at least one ignition pulse to be applied to the discharge lamp;

a computer control means electrically connected with said power adjustment means and said ignition pulse production means, said computer control means controlling said power adjustment means and said ignition pulse production means so that at first said power adjustment means supplies an idling voltage to the discharge lamp, then said ignition pulse production means lights up the discharge lamp by applying at least one ignition pulse to the discharge lamp, and thereafter said power adjustment means controls lamp power of the discharge lamp to a target lamp power; and a set switch capable of supplying a variable signal to said computer control means, said power adjustment means being capable of selectively supplying DC power or AC power to the discharge lamp, said computer control means preliminarily storing a plurality of different periods of the DC power supply, and selecting one of the stores periods depending upon the variable signal from said set switch.

* * * * *